US009079651B2

(12) United States Patent
Nose et al.

(10) Patent No.: US 9,079,651 B2
(45) **Date of Patent: *Jul. 14, 2015**

(54) MARINE VESSEL PROPULSION SYSTEM AND MARINE VESSEL INCLUDING THE SAME

(75) Inventors: Yukinori Nose, Shizuoka (JP); Toshiya Inai, Shizuoka (JP); Yoshiyuki Ichikawa, Shizuoka (JP); Makoto Mizutani, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 966 days.

This patent is subject to a terminal disclaimer.

(21) Appl. No.: 12/647,638

(22) Filed: Dec. 28, 2009

(65) Prior Publication Data

US 2010/0191396 A1 Jul. 29, 2010

(30) Foreign Application Priority Data

Jan. 27, 2009 (JP) ..... 2009-014987

(51) Int. Cl.
*B63H 21/21* (2006.01)
*B63H 25/42* (2006.01)
*B63H 20/12* (2006.01)

(52) U.S. Cl.
CPC ..... *B63H 25/42* (2013.01); *B63H 20/12* (2013.01)

(58) Field of Classification Search
CPC ..... B63B 49/00; B63H 21/213; B63H 21/22; B63H 25/42; B63H 20/02; G05D 1/0206; H01H 25/041; H01H 13/70; H01H 25/008; H01H 2300/008; H01H 9/26
USPC ..... 701/21; 200/5 R; 440/53, 40, 42, 43, 57, 440/61 R
See application file for complete search history.

(56) References Cited

U.S. PATENT DOCUMENTS 4,637,802 A * 1/1987 Taguchi et al. ..... 440/75
5,031,561 A 7/1991 Nilsson (Continued)

FOREIGN PATENT DOCUMENTS

JP 01-285486 A 11/1989
JP 06-024388 A 2/1994
JP 2005-200004 A 7/2005

OTHER PUBLICATIONS

"Concept and Operation Mode of the Advanced Electronic Control System of the Azimuth Propellers in Tugs"; retrieved from "http://www.jmr.unican.es/pub/00203/0020301.pdf" on Jul. 22, 2013; Santiago Iglesias Baniela, Pablo Lopez Varela, Enrique Melon Rodriguez; 2005; Journal of maritime research: JMR 2.3 (2005): 3-21.*

(Continued)

*Primary Examiner* — Redhwan K Mawari
*Assistant Examiner* — Edward Torchinsky
(74) *Attorney, Agent, or Firm* — Keating & Bennett, LLP

(57) ABSTRACT

A marine vessel propulsion system includes multiple propulsion devices, multiple operation levers, and multiple lever position sensors arranged to detect the positions of the multiple operation levers, and a control unit. The control unit is programmed to control, based on detection results from the multiple lever position sensors, the shift states of the respective propulsion devices and to change the steering angle of at least one of the propulsion devices. The control unit may be arranged to change the steering angles of the propulsion devices to facilitate the behavior of the hull corresponding to the shift states of the respective propulsion devices.

26 Claims, 23 Drawing Sheets

(56) References Cited

U.S. PATENT DOCUMENTS

| | | | | |
|---|---|---|---|---|
| 5,090,929 | A * | 2/1992 | Rieben | 440/40 |
| 6,234,853 | B1 * | 5/2001 | Lanyi et al. | 440/53 |
| 6,273,711 | B1 * | 8/2001 | Duva | 431/346 |
| 6,538,217 | B1 * | 3/2003 | Eriksen et al. | 200/5 R |
| 6,578,589 | B1 * | 6/2003 | Gima et al. | 134/61 |
| 6,848,382 | B1 * | 2/2005 | Bekker | 114/144 B |
| 6,854,406 | B2 * | 2/2005 | Cardoza et al. | 114/144 RE |
| 6,865,996 | B2 * | 3/2005 | Borrett | 114/144 B |
| 6,965,817 | B2 * | 11/2005 | Graham et al. | 701/21 |
| 6,978,729 | B2 * | 12/2005 | Bertetti et al. | 440/1 |
| 6,994,046 | B2 * | 2/2006 | Kaji et al. | 114/144 R |
| 7,006,905 | B2 * | 2/2006 | Hamamatsu et al. | 701/21 |
| 7,036,445 | B2 * | 5/2006 | Kaufmann et al. | 114/144 RE |
| 7,037,150 | B2 * | 5/2006 | Morvillo | 440/40 |
| 7,047,115 | B2 * | 5/2006 | Takada et al. | 701/21 |
| 7,052,338 | B2 * | 5/2006 | Morvillo | 440/41 |
| 7,070,469 | B2 * | 7/2006 | Stallings | 440/79 |
| 7,131,385 | B1 * | 11/2006 | Ehlers et al. | 114/145 R |
| 7,150,662 | B1 * | 12/2006 | Janitz | 440/6 |
| 7,188,581 | B1 * | 3/2007 | Davis et al. | 114/285 |
| 7,216,599 | B2 * | 5/2007 | Morvillo | 114/144 RE |
| 7,222,577 | B2 * | 5/2007 | Morvillo | 114/144 RE |
| 7,234,983 | B2 * | 6/2007 | Davis | 440/68 |
| 7,267,068 | B2 * | 9/2007 | Bradley et al. | 114/144 R |
| 7,294,031 | B1 * | 11/2007 | Davis et al. | 440/112 |
| 7,305,928 | B2 * | 12/2007 | Bradley et al. | 114/144 R |
| 7,311,572 | B2 * | 12/2007 | Yamashita et al. | 440/63 |
| 7,320,629 | B2 * | 1/2008 | Okuyama | 440/53 |
| 7,325,505 | B2 | 2/2008 | Otobe et al. | |
| 7,347,752 | B2 * | 3/2008 | Morvillo | 440/41 |
| 7,371,140 | B2 * | 5/2008 | Davis | 440/69 |
| 7,398,742 | B1 * | 7/2008 | Gonring | 114/144 R |
| 7,416,458 | B2 * | 8/2008 | Suemori et al. | 440/53 |
| 7,455,557 | B2 | 11/2008 | Mizutani | |
| 7,641,525 | B2 * | 1/2010 | Morvillo | 440/42 |
| 7,878,872 | B2 * | 2/2011 | Strobel | 440/63 |
| 8,117,890 | B1 * | 2/2012 | Durmeyer et al. | 73/1.75 |
| 8,131,412 | B2 * | 3/2012 | Larsson et al. | 701/21 |
| 8,170,733 | B2 * | 5/2012 | Blum et al. | 701/21 |
| 8,234,024 | B2 * | 7/2012 | Nose et al. | 701/21 |
| 2006/0105647 | A1 | 5/2006 | Yazaki et al. | |
| 2006/0264127 | A1 * | 11/2006 | Gibbs | 440/12.59 |
| 2007/0017426 | A1 | 1/2007 | Kaji et al. | |
| 2007/0093147 | A1 * | 4/2007 | Mizutani | 440/1 |
| 2007/0207683 | A1 | 9/2007 | Mizutani | |
| 2008/0119096 | A1 * | 5/2008 | Ito et al. | 440/87 |

OTHER PUBLICATIONS http://www.hamiltonjet.com/links/bluearrowbrochure.pdf; Hamilton Jet Blue Arrow.*

"Docking in Style With Twin Screw Boats"; author: David H. Pascoe; http://www.yachtsurvey.com/docking.htm, retrieved on Nov. 18, 2013; authored: Jun. 30, 1998.*

Official Communication issued in corresponding European Patent Application No. 09180817.0, mailed on Nov. 2, 2012.

* cited by examiner

FIG. 7

| | OPERATION LEVER POSITION | | STEERING ANGLE (DEGREE) | | SHIFT STATE | |
|---|---|---|---|---|---|---|
| | LEFT | RIGHT | LEFT | RIGHT | LEFT | RIGHT |
| | NEUTRAL | NEUTRAL | 0 | 0 | N | N |
| (A2) | NEUTRAL | FORWARD DRIVE | 0 | -10 | N | F |
| (B2) | NEUTRAL | REVERSE DRIVE | 0 | -10 | N | R |
| | | | | | | |
| (A1) | FORWARD DRIVE | NEUTRAL | +10 | 0 | F | N |
| | FORWARD DRIVE | FORWARD DRIVE | 0 | 0 | F | F |
| (C1) | FORWARD DRIVE | REVERSE DRIVE | +10 | -10 | F | R |
| | | | | | | |
| (B1) | REVERSE DRIVE | NEUTRAL | +10 | 0 | R | N |
| (C2) | REVERSE DRIVE | FORWARD DRIVE | +10 | -10 | R | F |
| | REVERSE DRIVE | REVERSE DRIVE | 0 | 0 | R | R |

FIG. 14

| | OPERATION LEVER POSITION | | THROTTLE OPENING DEGREE (%) | | STEERING ANGLE (DEGREE) | | SHIFT STATE | |
|---|---|---|---|---|---|---|---|---|
| | LEFT | RIGHT | LEFT | RIGHT | LEFT | RIGHT | LEFT | RIGHT |
| | NEUTRAL | NEUTRAL | 0 | 0 | 0 | 0 | N | N |
| (A2) | NEUTRAL | FORWARD DRIVE | 0 | 0-100 | 0 | -2~-10 | N | F |
| (B2) | NEUTRAL | REVERSE DRIVE | 0 | 0-100 | 0 | -2~-10 | N | R |
| | | | | | | | | |
| (A1) | FORWARD DRIVE | NEUTRAL | 0-100 | 0 | +2~+10 | 0 | F | N |
| | FORWARD DRIVE | FORWARD DRIVE | 0-100 | 0-100 | 0 | 0 | F | F |
| (C1) | FORWARD DRIVE | REVERSE DRIVE | 0-100 | 0-100 | +2~+10 | -2~-10 | F | R |
| | | | | | | | | |
| (B1) | REVERSE DRIVE | NEUTRAL | 0-100 | 0 | +2~+10 | 0 | R | N |
| (C2) | REVERSE DRIVE | FORWARD DRIVE | 0-100 | 0-100 | +2~+10 | -2~-10 | R | F |
| | REVERSE DRIVE | REVERSE DRIVE | 0-100 | 0-100 | 0 | 0 | R | R |

FIG. 17

| | OPERATION LEVER POSITION | | STEERING ANGLE (DEGREE) | | SHIFT STATE | |
|---|---|---|---|---|---|---|
| | LEFT | RIGHT | LEFT | RIGHT | LEFT | RIGHT |
| | NEUTRAL | NEUTRAL | 0 | 0 | N | N |
| (A2) | NEUTRAL | FORWARD DRIVE | 0 | -10 | N | F |
| (B2) | NEUTRAL | REVERSE DRIVE | 0 | -10 | N | R |
| | | | | | | |
| (A1) | FORWARD DRIVE | NEUTRAL | +10 | 0 | F | N |
| | FORWARD DRIVE | FORWARD DRIVE | 0 | 0 | F | F |
| (E1) | FORWARD DRIVE | REVERSE DRIVE | -10 | +10 | F | R |
| | | | | | | |
| (B1) | REVERSE DRIVE | NEUTRAL | +10 | 0 | R | N |
| (E2) | REVERSE DRIVE | FORWARD DRIVE | -10 | +10 | R | F |
| | REVERSE DRIVE | REVERSE DRIVE | 0 | 0 | R | R |

FIG. 20

| | OPERATION LEVER POSITION | | THROTTLE OPENING DEGREE (%) | | STEERING ANGLE (DEGREE) | | SHIFT STATE | |
|---|---|---|---|---|---|---|---|---|
| | LEFT | RIGHT | LEFT | RIGHT | LEFT | RIGHT | LEFT | RIGHT |
| | NEUTRAL | NEUTRAL | 0 | 0 | 0 | 0 | N | N |
| (A2) | NEUTRAL | FORWARD DRIVE | 0 | 0-100 | 0 | -2~-10 | N | F |
| (B2) | NEUTRAL | REVERSE DRIVE | 0 | 0-100 | 0 | -2~-10 | N | R |
| | | | | | | | | |
| (A1) | FORWARD DRIVE | NEUTRAL | 0-100 | 0 | +2~+10 | 0 | F | N |
| | FORWARD DRIVE | FORWARD DRIVE | 0-100 | 0-100 | 0 | 0 | F | F |
| (E1) | FORWARD DRIVE | REVERSE DRIVE | 0-100 | 0-100 | -10 | +10 | F | R |
| | | | | | | | | |
| (B1) | REVERSE DRIVE | NEUTRAL | 0-100 | 0 | +2~+10 | 0 | R | N |
| (E2) | REVERSE DRIVE | FORWARD DRIVE | 0-100 | 0-100 | -10 | +10 | R | F |
| | REVERSE DRIVE | REVERSE DRIVE | 0-100 | 0-100 | 0 | 0 | R | R |

MARINE VESSEL PROPULSION SYSTEM AND MARINE VESSEL INCLUDING THE SAME

BACKGROUND OF THE INVENTION

1. Field of the Invention

The present invention relates to a marine vessel propulsion system including operation levers arranged to be operated for controlling the respective shift states of multiple propulsion devices. The present invention also relates to a marine vessel including such a system.

2. Description of the Related Art

There has been known a marine vessel propulsion system including operation levers arranged to be operated by a marine vessel maneuvering operator to control the respective shift states of multiple propulsion devices. One example of such a propulsion device is an outboard motor.

Such a marine vessel propulsion system includes, for example, two outboard motors mounted on a hull. The two outboard motors are coupled to each other with a tie bar and arranged to have substantially the same steering angle. The marine vessel propulsion system further includes two operation levers corresponding to the two respective outboard motors. The shift state and throttle opening degree of each outboard motor can be adjusted independently by operating the corresponding operation lever. In addition, the two outboard motors are steerable through one steering mechanism.

The thus arranged marine vessel propulsion system requires a complicated operation when finely controlling the movement of the marine vessel such as when launching from and docking on shore. That is, the operator is required to finely control both the steering mechanism and the two operation levers.

The hull may include a side thruster (propulsion device for lateral movement) for easier marine vessel maneuvering when launching from and docking on shore. This, however, results in the marine vessel propulsion system having a complex structure, and is not suitable particularly for small marine vessels.

United States Patent Application Publication No. US2007/0017426A1 discloses a marine vessel propulsion system that can finely control the movement of the marine vessel easily without providing a side thruster.

This marine vessel propulsion system includes two operation levers corresponding, respectively, to two outboard motors and a cross-shaped key provided separately from the two operation levers. The shift state and throttle opening degree of each outboard motor can be adjusted independently by operating the corresponding operation lever. In addition, the two outboard motors are steerable through one steering mechanism. This marine vessel propulsion system can set a marine vessel maneuvering support mode. In the marine vessel maneuvering support mode, operating the cross-shaped key causes the steering angle, shift state, and throttle opening degree of each outboard motor to be adjusted so that the hull moves in the direction indicated by the cross-shaped key. This allows the movement of the marine vessel to be controlled finely and easily without a side thruster.

SUMMARY OF THE INVENTION

The inventors of preferred embodiments of the present invention described and claimed in the present application conducted an extensive study and research regarding a marine vessel propulsion system, such as the one described above, and in doing so, discovered and first recognized new unique challenges and previously unrecognized possibilities for improvements as described in greater detail below.

That is, the related art above requires two operation levers and a cross-shaped key to be provided separately, resulting in the marine vessel propulsion system having a complex structure. That is, even though no side thruster is provided, an additional operation system defined by the cross-shaped key, must be provided in addition to the operation levers and the steering mechanism. This results in complexity in the structure and requires somewhat more complicated operations due to an increase in the number of operation systems.

In order to overcome the previously unrecognized and unsolved challenges described above, a preferred embodiment of the present invention provides a marine vessel propulsion system including multiple propulsion devices arranged to be mounted on a hull so as to enable a steering angle to change, multiple operation levers, multiple lever position sensors, and a control unit. The multiple operation levers are arranged to be operated by a marine vessel maneuvering operator to control changes in respective shift states of the multiple propulsion devices selected from among a forward drive state, a neutral state, and a reverse drive state. The multiple lever position sensors are provided correspondingly to the multiple respective operation levers and arranged to detect the positions of the operation levers. The control unit is programmed to control the shift states of the respective propulsion devices and to change the steering angle of at least one of the propulsion devices based on detection results from the multiple lever position sensors.

In the thus arranged marine vessel propulsion system, the shift states of the respective propulsion devices are controlled and further the steering angle of at least one of the propulsion devices is changed based on detection results from the multiple lever position sensors. That is, not only the shift states but also the steering angle follows the detection results from the lever position sensors. This arrangement allows the propulsive forces of the propulsion devices to act effectively on the hull. This allows the hull to have a smaller turning radius, at the time of turning movement of the hull, for example. It is further possible to change the behavior of the hull quickly and highly responsively. As a result, the movement of the marine vessel can be precisely controlled.

In addition, since the marine vessel can be controlled only by operating the operation levers, there is no need to operate the steering mechanism. It is therefore possible to improve the operability when finely controlling the movement of the marine vessel. There is also no need to provide another operation system such as a cross-shaped key separately from the operation levers, which can prevent the marine vessel propulsion system from having a complex structure. Since there is no need to add another operation system, no complicated operations are required.

In another preferred embodiment of the present invention, the control unit is programmed to control, based on detection results from the multiple lever position sensors, the shift states of the respective propulsion devices and to change the steering angle of at least one of the propulsion devices to facilitate the behavior of the hull corresponding to the shift states of the respective propulsion devices. This arrangement allows the propulsive forces of the propulsion devices to act in the direction of the movement of the hull. This allows the hull to have a smaller turning radius, at the time of turning movement of the hull, for example. It is further possible to change the behavior of the hull quickly and highly responsively. As a result, the movement of the marine vessel can be precisely controlled.

The control unit is preferably programmed to control the shift states of the respective propulsion devices based on detection results from the multiple lever position sensors such that the positions of the operation levers correspond to the shift states of the respective propulsion devices.

With this arrangement, the positions of the operation levers correspond to the shift states of the respective propulsion devices. Thus, the operator can recognize in which direction a propulsive force is applied to the hull while he or she operates the operation levers. This allows the operator to easily imagine the behavior (e.g., turning motion, pivoting motion) of the marine vessel caused by operating the operation levers. In addition, controlling the steering angle allows the propulsive forces of the propulsion devices to act in the direction of the movement of the hull. It is therefore possible to achieve the behavior of the marine vessel quickly and highly responsively as the operator imagines. As a result, the operability of the marine vessel by the operator can be further improved.

In the case described above, the multiple propulsion devices preferably include a first propulsion device group including at least one of the propulsion devices and a second propulsion device group including at least one of the propulsion devices not included in the first propulsion device group. Also, the multiple operation levers preferably include a first operation lever corresponding to the first propulsion device group and a second operation lever corresponding to the second propulsion device group. Further, the control unit is preferably programmed to change, when the position of the first operation lever is different from the position of the second operation lever, the steering angle of at least one of the propulsion devices to facilitate the behavior of the hull corresponding to the shift states of the respective first and second propulsion device groups. For example, the operator may set the first and second operation levers in their respective different positions to turn the hull. In this case, the hull can have a smaller turning radius and it is possible to change the behavior of the hull quickly and highly responsively.

Further, the first and second operation levers are preferably arranged to be movable among a forward drive position corresponding to the forward drive state, a neutral position corresponding to the neutral state, and a reverse drive position corresponding to the reverse drive state. Then, the control unit is preferably programmed to change, when the position of the first operation lever (forward drive, neutral, or reverse drive position) is different from the position of the second operation lever (forward drive, neutral, or reverse drive position), the steering angle of at least one of the propulsion devices to facilitate the behavior of the hull corresponding to the shift states of the respective first and second propulsion device groups.

In the case described above, the control unit is further preferably programmed to control, when the first operation lever is in the neutral position and the second operation lever is in a position other than the neutral position, the shift state of the first propulsion device group to be the neutral state and the shift state of the second propulsion device group to be the forward or reverse drive state. Then, the control unit is preferably programmed to change the steering angle of at least one of the propulsion devices so as to face a direction for facilitating or promoting the turning motion of the hull that occurs according to the combination of the shift states of the respective first and second propulsion device groups. With this arrangement, the hull can be applied with a propulsive force in the turning direction to consequently have a smaller turning radius. It is also possible to change the behavior of the hull quickly and highly responsively.

The control unit is preferably programmed to change, when the first operation lever is in one of the forward and reverse drive positions and the second operation lever is in the other of the forward and reverse drive positions, the steering angles of the respective first and second propulsion device groups to bring the rear end portion of the first propulsion device group and the rear end portion of the second propulsion device group close to each other so that the hull pivots. This arrangement allows the propulsive forces of the first and second propulsion device groups to act in the pivoting direction of the hull. That is, the hull can be applied with a propulsive force in a direction deviated from the rotational center of the hull. This allows the hull to rotate or pivot quickly and highly responsively without being largely displaced, i.e., preferably with no displacement.

In a preferred embodiment of the present invention, the multiple propulsion devices include a first propulsion device group including at least one of the propulsion devices and a second propulsion device group including at least one of the propulsion devices not included in the first propulsion device group. Also, the multiple operation levers include a first operation lever corresponding to the first propulsion device group and a second operation lever corresponding to the second propulsion device group. The first and second operation levers are arranged to be movable among a forward drive position corresponding to the forward drive state, a neutral position corresponding to the neutral state, and a reverse drive position corresponding to the reverse drive state. Further, the control unit is programmed to change, when the first operation lever is in one of the forward and reverse drive positions and the second operation lever is in the other of the forward and reverse drive positions, the steering angles of the respective first and second propulsion device groups to move the rear end portion of the first propulsion device group and the rear end portion of the second propulsion device group away from each other so that the hull moves laterally. More specifically, the propulsive forces of the first and second propulsion device groups act on the hull toward the rotational center thereof. Therefore, the hull cannot be applied with a large moment, and the hull moves laterally, for example, in the direction of the resultant vector of propulsive force vectors generated by the first and second propulsion device groups. Thus, the hull can move laterally with the propulsive forces of the first and second propulsion device groups without providing a side thruster on the hull.

In a preferred embodiment of the present invention, the control unit is programmed to maintain a certain amount of change in the steering angle of each propulsion device regardless of the amount of displacement of each operation lever with respect to the neutral position. This arrangement allows the change in the behavior (speed) of the hull to be adjusted in faithful accordance with the operation amount of each operation lever.

In another preferred embodiment of the present invention, the control unit is programmed to change the amount of change in the steering angle of each propulsion device according to the amount of displacement of each operation lever with respect to the neutral position. With this arrangement, the amount of change in the steering angle of each propulsion device can be increased by increasing the amount of operation of each operation lever. This allows a turning or pivoting force to act more forcefully on the hull, for example, when the amount of operation of each operation lever is increased. This allows the hull to have a smaller turning radius and it is possible to change the behavior of the hull more quickly and highly responsively.

The marine vessel propulsion system according to a preferred embodiment of the present invention further includes a steering mechanism arranged to be operated by a marine vessel maneuvering operator to change the steering angles of the respective propulsion devices, a steering angle sensor arranged to detect the rotation angle of the steering mechanism, and a switching unit arranged to switch between normal marine vessel maneuvering control and assisted marine vessel maneuvering control. In this case, it is preferred that in the normal marine vessel maneuvering control, the control unit is programmed to control the shift states and propulsive forces of the respective propulsion devices based on detection results from the multiple lever position sensors and to change the steering angles of the respective propulsion devices based on a detection result from the steering angle sensor. It is also preferred that in the assisted marine vessel maneuvering control, the control unit is programmed to control the shift states and propulsive forces of the respective propulsion devices based on detection results from the multiple lever position sensors and to change the steering angle of at least one of the propulsion devices. In the normal control, the operator can use the steering mechanism for steering. When it is required to finely control the movement of the marine vessel (such as when launching from and docking on shore), the operator can use only the operation levers for steering by switching to the assisted marine vessel maneuvering control. This can improve the convenience for operators.

In the case described above, the control unit may be programmed to control, in the assisted marine vessel maneuvering control, each propulsion device to have a propulsive force smaller than that corresponding to the position of each operation lever in the normal marine vessel maneuvering control.

Preferably, the propulsion devices each include an outboard motor arranged to be mounted on the hull so as to enable a steering angle to change. The outboard motor includes, for example, an engine with the driving force thereof being adjustable through control of throttle opening degree, a propeller arranged to be rotated by a driving force from the engine, and a switching mechanism portion arranged to switch shift states. The operation levers are preferably arranged to be operated by a marine vessel maneuvering operator to control respective shift states of the multiple outboard motors and throttle opening degrees of the outboard motors. The control unit is preferably programmed to control the shift states and throttle opening degrees of the respective outboard motors based on detection results from the multiple lever position sensors and to change the steering angle of at least one of the outboard motors. With this arrangement, the marine vessel propulsion system including outboard motors can improve the operability when finely controlling the movement of the marine vessel.

A preferred embodiment of the present invention provides a marine vessel including a hull and a marine vessel propulsion system mounted on the hull and having the above-described features. This arrangement can improve the operability when finely controlling the movement of the marine vessel while preventing the marine vessel propulsion system from having a complex structure.

Other elements, features, steps, characteristics and advantages of the present invention will become more apparent from the following detailed description of the preferred embodiments with reference to the attached drawings.

BRIEF DESCRIPTION OF THE DRAWINGS

FIG. 7 shows the relationship between the position of each operation lever and the shift state as well as steering angle of each outboard motor when the marine vessel propulsion system is in the assisted marine vessel maneuvering mode.

FIG. 14 shows the relationship between the position of each operation lever and the shift state as well as steering angle of each outboard motor when the marine vessel propulsion system according to the second preferred embodiment is in the assisted marine vessel maneuvering mode.

FIG. 17 shows the relationship between the position of each operation lever and the shift state as well as steering angle of each outboard motor when the marine vessel propulsion system according to the third preferred embodiment is in the assisted marine vessel maneuvering mode.

FIG. 20 shows the relationship between the position of each operation lever and the shift state as well as steering angle of each outboard motor when a marine vessel propulsion system according to a fourth preferred embodiment of the present invention is in an assisted marine vessel maneuvering mode.

DETAILED DESCRIPTION OF THE PREFERRED EMBODIMENTS

First Preferred Embodiment

The structure of a marine vessel propulsion system according to a first preferred embodiment of the present invention will be described with reference to FIGS. 1 to 5.

Figure 1:
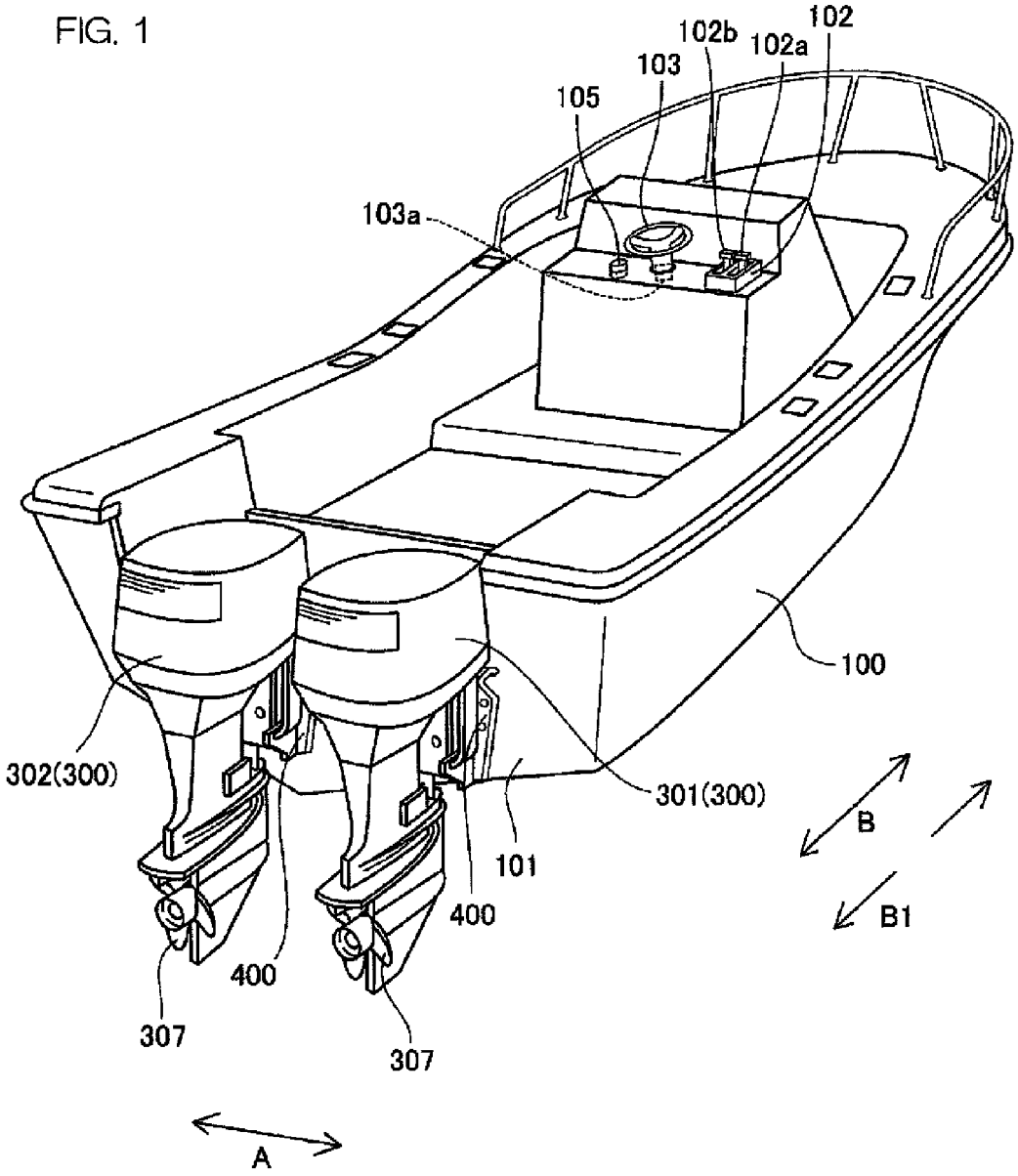
FIG. 1 is a perspective view of a marine vessel including a marine vessel propulsion system according to a first preferred embodiment of the present invention.
Figure 2:
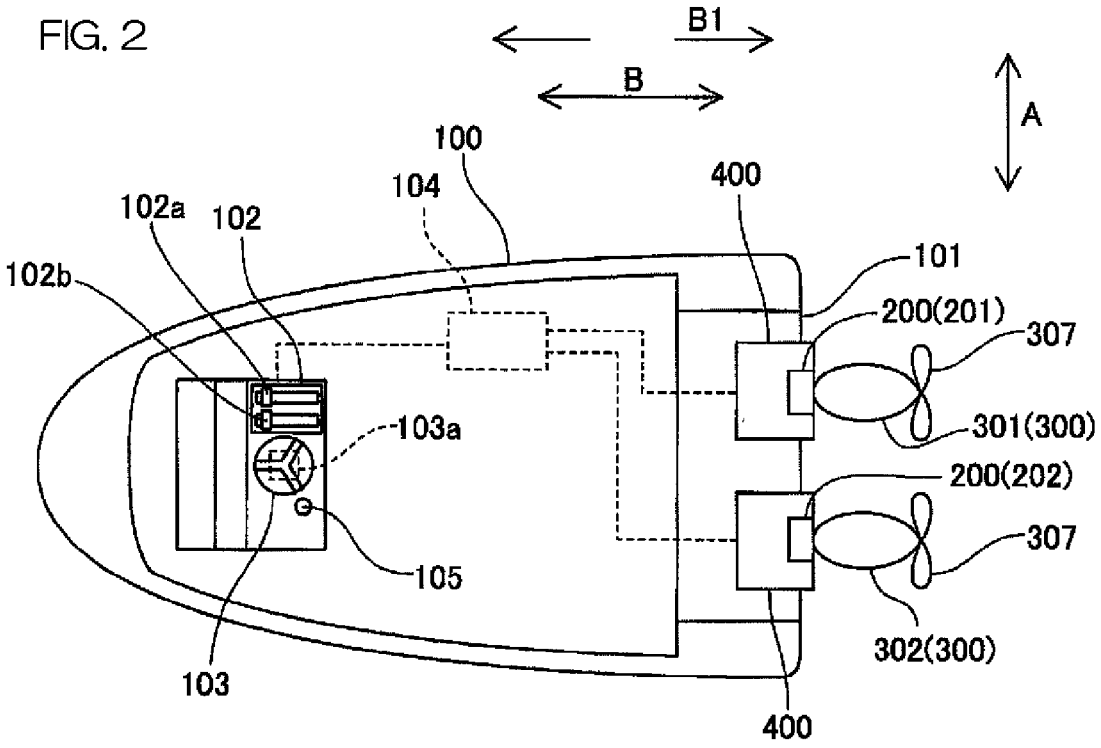
FIG. 2 is a schematic plan view showing the overall configuration of the marine vessel propulsion system.
Figure 5:
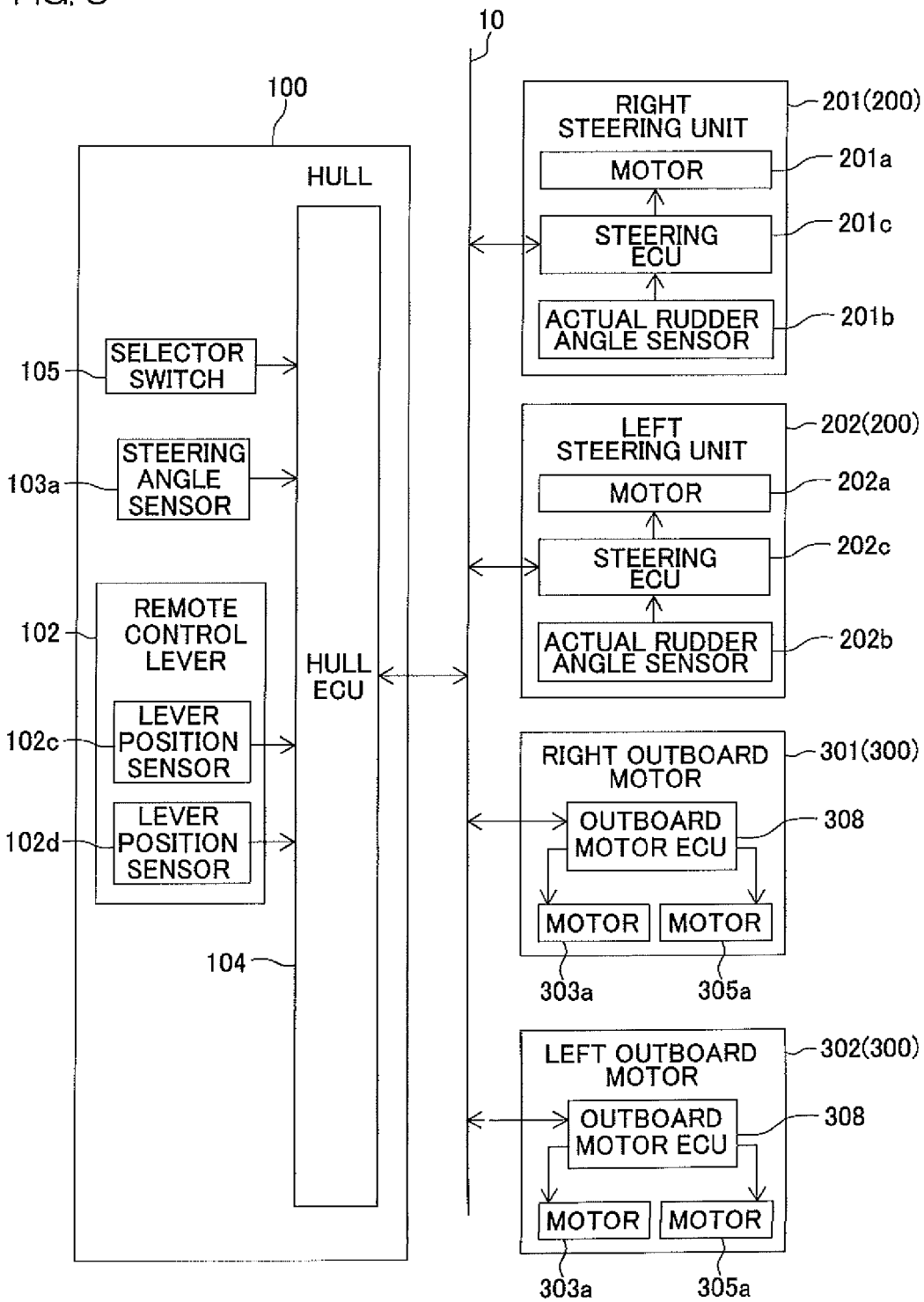
FIG. 5 is a block diagram showing the electrical configuration of the marine vessel propulsion system.

Two outboard motors 300 (right outboard motor 301 and left outboard motor 302) are mounted at the stern 101 of a hull 100 via two steering units 200 (right steering unit 201 and left steering unit 202) (see FIGS. 2 and 5). A remote control lever 102, a steering mechanism 103, a hull ECU (Electronic Control Unit) 104, a trim switch (not shown), and the like are arranged on the hull 100. The remote control lever 102 is arranged to be operated by a marine vessel maneuvering operator to control switching the throttle opening degrees and shift states of the outboard motors 300. The steering mechanism 103 is arranged to be operated by the operator to change the heading direction of the hull 100. The hull ECU 104 is programmed to control the marine vessel propulsion system. The trim switch is arranged to be operated by the operator to change the mounting angle of the outboard motors 300 with respect to the hull 100. The outboard motors 300 and the hull ECU 104 are, respectively, examples of "propulsion devices" and "control unit" according to a preferred embodiment of the present invention.

The remote control lever 102 includes two operation levers (right operation lever 102*a* and left operation lever 102*b*) that correspond to the respective right and left outboard motors 301 and 302. The right and left operation levers 102*a* and 102*b* are arranged laterally (in the direction A) and are arranged to be movable longitudinally (in the direction B) independently of each other. The operator can switch the shift state and perform acceleration control (throttle opening degree control) of the right outboard motor 301 by operating the right operation lever 102*a*. The operator can also switch the shift state and perform acceleration control of the left outboard motor 302 by operating the left operation lever 102*b*. The shift state of the outboard motors 301 and 302 can be selected from among neutral state, forward drive state, and reverse drive state. The right and left operation levers 102*a* and 102*b* are, respectively, examples of "first operation lever" and "second operation lever" according to a preferred embodiment of the present invention. Also, the right and left outboard motors 301 and 302 are, respectively, examples of "first propulsion device group" and "second propulsion device group" according to a preferred embodiment of the present invention.

Figure 3:
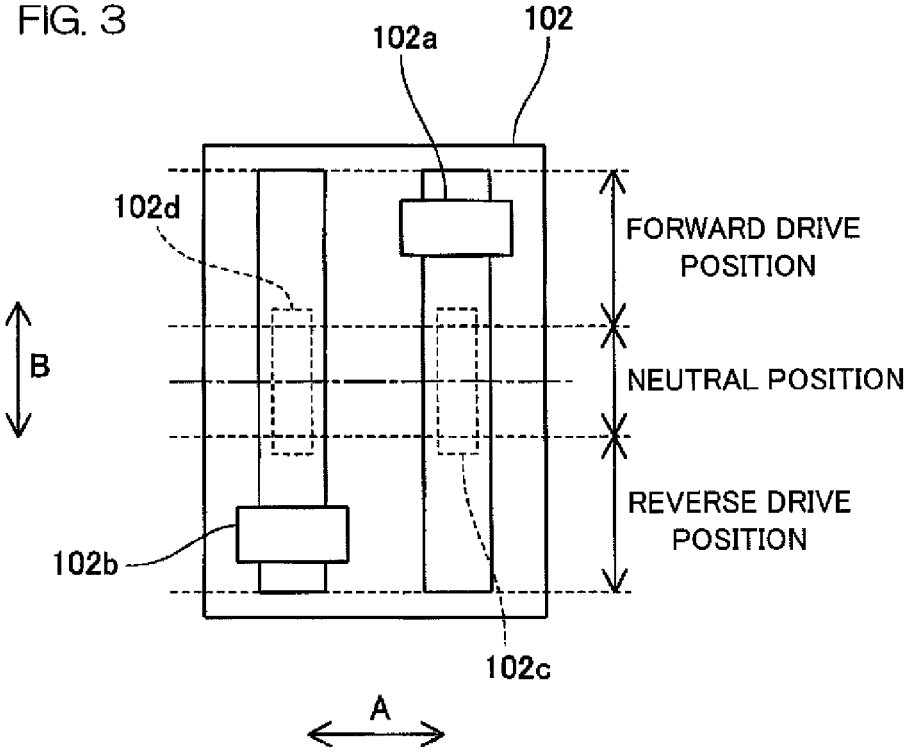
FIG. 3 is a schematic plan view of a control lever in the marine vessel propulsion system.

As shown in FIG. 3, the operation levers (right operation lever 102*a* and left operation lever 102*b*) are movable among a neutral position, a forward drive position, and a reverse drive position. The neutral position, forward drive position, and reverse drive position correspond, respectively, to the neutral state, forward drive state, and reverse drive state of the outboard motors 300. The marine vessel propulsion system is arranged to change the throttle opening degree of each outboard motor 300 according to the amount of displacement of the corresponding operation lever with respect to the neutral position when the operation lever is in the forward or reverse drive position. That is, the greater the amount of displacement of the operation lever with respect to the neutral position, the greater the throttle opening degree of the corresponding outboard motor 300 becomes. The remote control lever 102 includes lever position sensors 102*c* and 102*d* arranged to detect the turning angle of the operation levers, being provided correspondingly to the respective right and left operation levers 102*a* and 102*b*. The shift states and throttle opening degrees of the respective outboard motors 300 (right outboard motor 301 and left outboard motor 302) are controlled based on detection results from the lever position sensors 102*c* and 102*d*.

The steering mechanism 103 is also arranged to be operated by the operator to steer the outboard motors 300 (right outboard motor 301 and left outboard motor 302). The steering mechanism 103 is provided with a steering angle sensor 103*a* arranged to detect the turning angle of the steering mechanism 103.

The steering units 200 (right steering unit 201 and left steering unit 202) are each mounted at the stern 101 of the hull 100 via a clamp bracket 400. As shown in FIG. 5, the right steering unit 201 includes a motor 201*a* arranged to turn the corresponding outboard motor 300 during steering, an actual rudder angle sensor 201*b* arranged to detect the turning angle (actual rudder angle) of the outboard motor 300, and a steering ECU 201*c*. Similarly, the left steering unit 202 includes a motor 202*a* arranged to turn the corresponding outboard motor 300 during steering, an actual rudder angle sensor 202*b* arranged to detect the turning angle (actual rudder angle) of the outboard motor 300, and a steering ECU 202*c*. The hull ECU 104 and the steering ECUs 201*c* and 202*c* are arranged to be capable of communicating information with each other via a LAN (local area network) 10 built in the hull 100.

When the motors 201*a* and 202*a* are driven based on a detection result from the steering angle sensor 103*a*, the steering angles of the outboard motors 300 (right outboard motor 301 and left outboard motor 302) are adjusted accordingly. That is, when the bodies of the outboard motors 300 are turned horizontally, propellers 307 change their direction. This changes the heading direction of the hull 100 that depends on propulsive forces generated by the propellers 307.

The steering units 200 can change the steering angle of each outboard motor 300 preferably within an angular range of about 60 degrees (±30 degrees), for example. When the steering angles of the outboard motors 300 are adjusted based on a detection result from the steering angle sensor 103*a*, the motors 201*a* and 202*a* are controlled such that the right and left outboard motors 301 and 302 have substantially the same steering angle.

Figure 4:
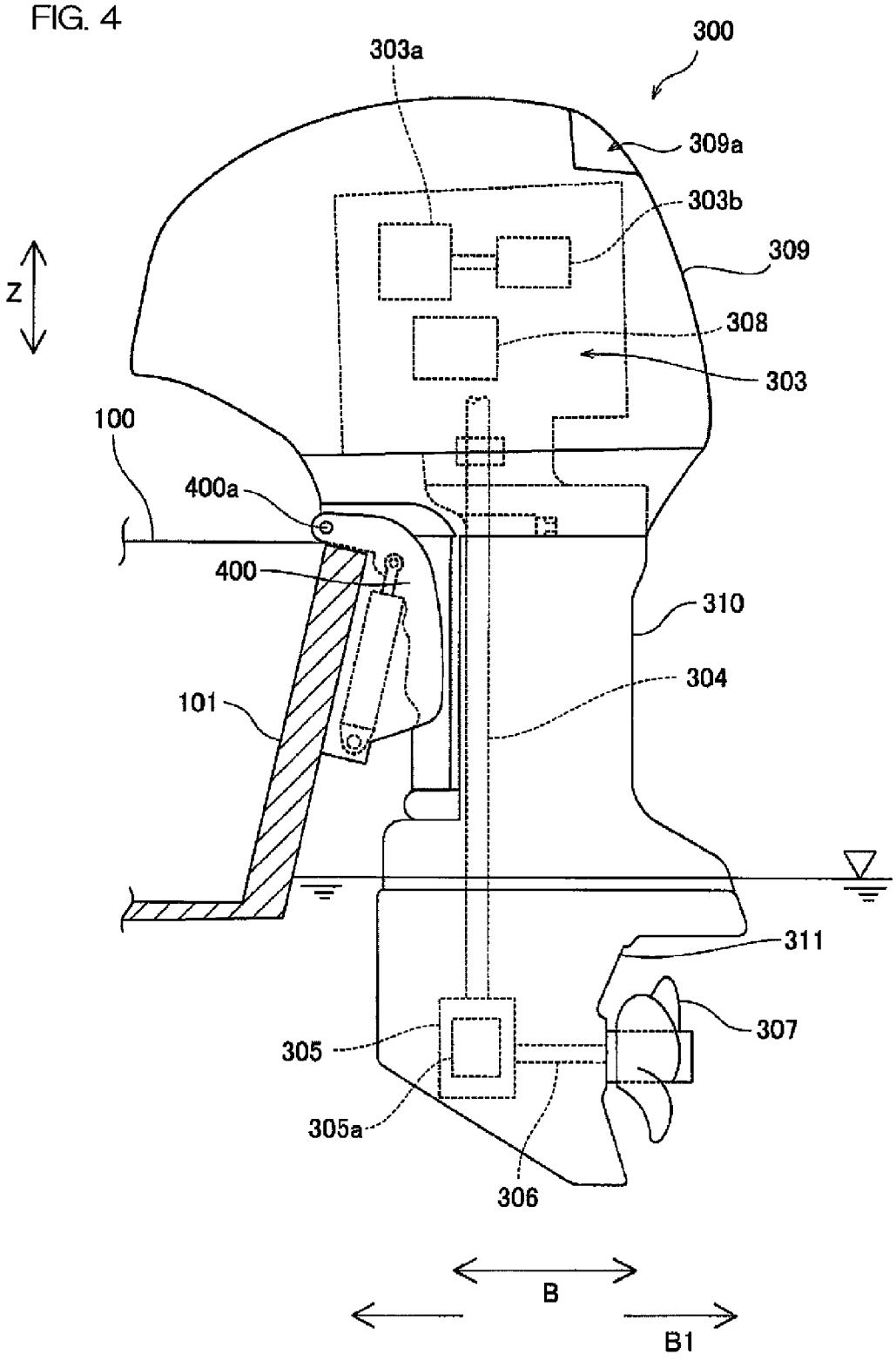
FIG. 4 is a side view of an outboard motor in the marine vessel propulsion system.

As shown in FIG. 4, the outboard motors 300 each include an engine 303, a drive shaft 304, a forward-reverse switching mechanism 305, a propeller shaft 306, a propeller 307, and an outboard motor ECU 308. The engine 303 is arranged to generate a driving force by burning a mixture of air and fuel. The drive shaft 304 extends in the vertical direction (in the Z direction) and is arranged to be rotated by a driving force from the engine 303. The forward-reverse switching mechanism 305 is connected to the lower end of the drive shaft 304. The propeller shaft 306 is connected to the forward-reverse switching mechanism 305 and extends in the horizontal direction. The propeller 307 is fixed at the rear end portion of the propeller shaft 306. The outboard motor ECU 308 is arranged to control the operations of the engine 303 and the forward-reverse switching mechanism 305. The hull ECU 104 and the outboard motor ECUs 308 in the right and left outboard motors are arranged to be capable of communicating information with each other via the LAN 10.

The engine 303 includes a motor 303*a* and a throttle valve 303*b*. The throttle valve 303*b* is provided in a feed path for feeding air therethrough into a mixture combustion chamber (not shown). The throttle valve 303*b* is arranged to be opened and closed by a driving force from the motor 303*a* within the range from the fully-closed state (with an opening degree of 0%) to the fully-opened state (with an opening degree of 100%). The motor 303*a* is controlled by the outboard motor ECU 308. The driving force of the engine 303 can be adjusted by controlling the opening degree (throttle opening degree) of the throttle valve 303*b* and therefore the feed amount of air.

The forward-reverse switching mechanism 305 is arranged to set a shift state selected from among forward drive state, reverse drive state, and neutral state. The forward drive state is a shift state in which the rotation of the drive shaft 304 caused by a driving force from the engine 303 is transmitted to rotate the propeller shaft 306 in the forward drive direction. The reverse drive state is a shift state in which the rotation of the drive shaft 304 is reversed and transmitted to rotate the propeller shaft 306 in the reverse drive direction. The neutral state is a shift state in which the transmitting of the rotation from the drive shaft 304 to the propeller shaft 306 is blocked off. The shift state is switched by a driving force from a motor 305*a*. The motor 305*a* is controlled by the outboard motor ECU 308.

The outboard motor ECU 308 controls the motors 303*a* and 305*a* and other electrical components in the outboard motor 300 based on signals from the hull ECU 104. The forward-reverse switching mechanism 305 is an example of a "switching mechanism portion" according to a preferred embodiment of the present invention.

The engine 303 is housed in an engine cover 309. An upper case 310 and a lower case 311 are arranged below the engine cover 309, and the drive shaft 304 and the forward-reverse switching mechanism 305 as well as the propeller shaft 306 are housed in the respective cases 310 and 311. A ventilation hole 309*a* is provided in a lateral portion of the engine cover 309 on the side of reverse drive direction (indicated by the arrow B1). Air which is introduced in the engine cover 309 via the ventilation hole 309*a*, is fed to the engine 303.

The outboard motors 300 are each mounted at the stern 101 of the hull 100 via a clamp bracket 400. The clamp bracket 400 supports each outboard motor 300 in a vertically swingable manner about a tilting shaft 400*a* with respect to the hull 100.

The hull 100 is provided with a selector switch 105 to be operated by the operator to switch control modes. The control modes include a normal marine vessel maneuvering mode in which the steering mechanism 103 is used for marine vessel maneuvering and an assisted marine vessel maneuvering mode in which the steering mechanism 103 is not required to be used for marine vessel maneuvering. One of these control modes can be selected by operating the selector switch 105.

In the normal marine vessel maneuvering mode, the shift states and throttle opening degrees of the respective right and left outboard motors 301 and 302 are controlled based on detection results from the lever position sensors 102*c* and 102*d*. The steering angle of the outboard motors 300 (right outboard motor 301 and left outboard motor 302) is also controlled based on a detection result from the steering angle sensor 103*a*.

In the assisted marine vessel maneuvering mode, the shift states, throttle opening degrees, and steering angles of the respective right and left outboard motors 301 and 302 are controlled based on detection results from the lever position sensors 102*c* and 102*d*.

The operator can switch between the normal marine vessel maneuvering mode and the assisted marine vessel maneuvering mode by switching the selector switch 105 ON and OFF. That is, when the selector switch 105 is OFF, the normal marine vessel maneuvering mode runs. When the selector switch 105 is ON, the assisted marine vessel maneuvering mode runs. In the assisted marine vessel maneuvering mode, when the steering mechanism 103 is operated, the selector switch 105 is turned OFF automatically by the control of the hull ECU 104 and the normal marine vessel maneuvering mode runs automatically. The selector switch 105 is an example of a "switching unit" according to a preferred embodiment of the present invention.

Figure 6:
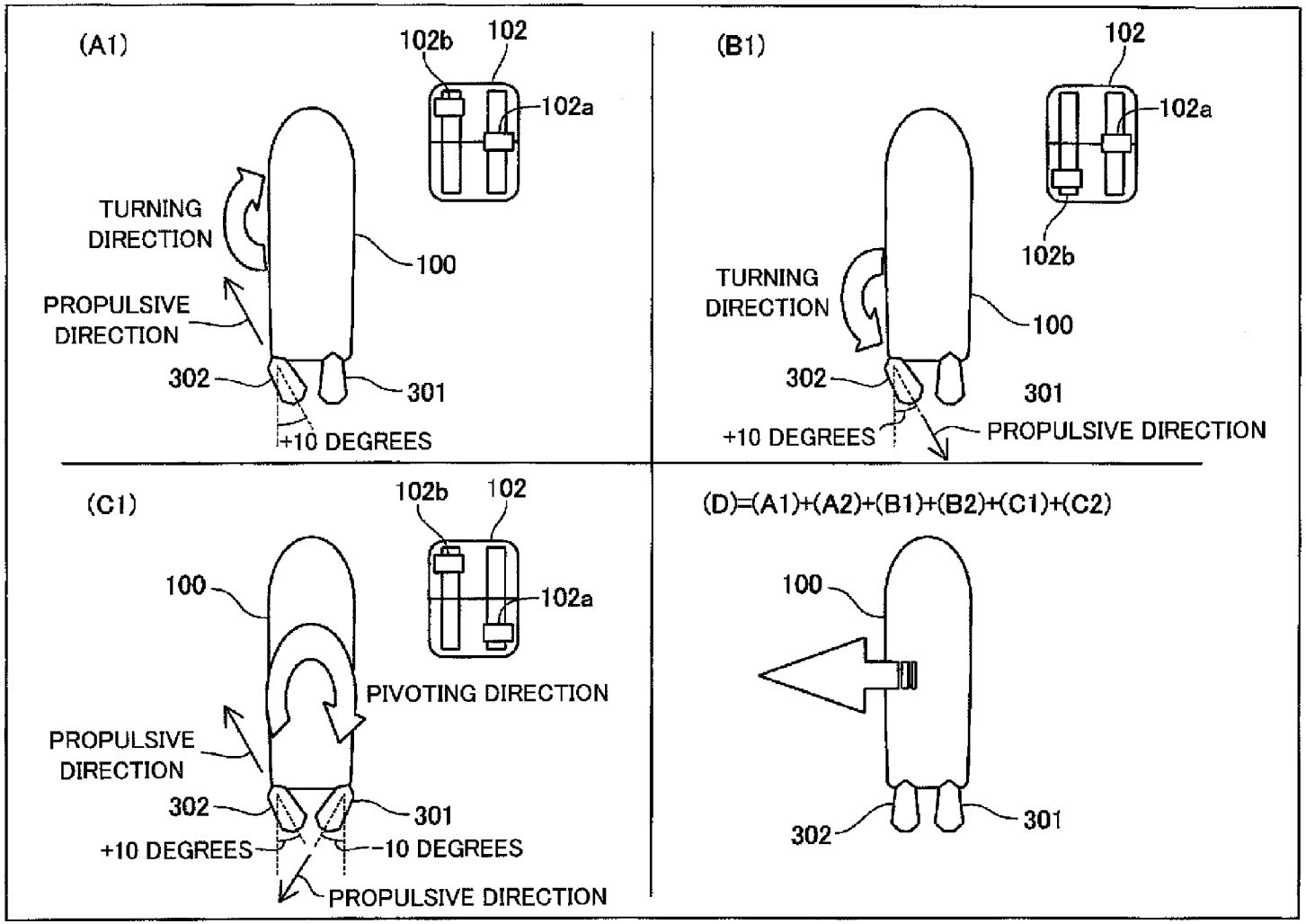
FIG. 6 illustrates steering angle control when the marine vessel propulsion system is in an assisted marine vessel maneuvering mode.

Next will be described the control when the marine vessel propulsion system according to the first preferred embodiment of the present invention is in the assisted marine vessel maneuvering mode with reference to FIGS. 6 and 7. It is noted that the "propulsive direction" indicated by the arrows in FIG. 6 is a direction of a propulsive force applied to the hull 100 by the right and left outboard motors 301 and 302. The length of each arrow represents the magnitude of a propulsive force by the right and left outboard motors 301 and 302.

As shown in FIG. 7, in the assisted marine vessel maneuvering mode, the positions of the operation levers (forward drive, reverse drive, and neutral positions) correspond to the shift states of the respective outboard motors 300 (forward drive (F), reverse drive (R), and neutral (N)). The amount of displacement of each operation lever with respect to the neutral position also corresponds to the throttle opening degree, though not shown in the figure. Therefore, the relationship between the position of each operation lever and the shift state as well as throttle opening degree of each outboard motor 300 is substantially the same as in the normal marine vessel maneuvering mode.

When the shift state of the right outboard motor 301 corresponding to the position of the right operation lever 102*a* is the same as the shift state of the left outboard motor 302 corresponding to the position of the left operation lever 102*b*, the operation is the same as in the normal marine vessel maneuvering mode. That is, the steering angle of the outboard motors 300 is not changed, and only the shift states and throttle opening degrees of the outboard motors 300 are changed. Specifically, when both the right and left operation levers 102*a* and 102*b* are in the neutral position, the shift states of the right and left outboard motors 301 and 302 are both neutral (N). In this case, the throttle opening degrees of the right and left outboard motors 301 and 302 are both in the fully-closed state (with an opening degree of 0%). When both the right and left operation levers 102*a* and 102*b* are in the forward or reverse drive position, the shift states of the right and left outboard motors 301 and 302 are both forward drive (F) or reverse drive (R). Then, the right and left outboard motors 301 and 302 have their respective throttle opening degrees (0 to 100%) that correspond to the amount of displacement of the respective operation levers with respect to the neutral position.

When the shift states of the right and left outboard motors 301 and 302 are different from each other, not only the shift states and throttle opening degrees of the outboard motors 300 but also the steering angles of the outboard motors 300 are changed. That is, the steering angles of the outboard motors 300 are changed to promote the behavior of the hull 100 according to a propulsive force generated by the outboard motors 300.

For example, as indicated by (A1) in FIG. 7, when the right and left operation levers 102*a* and 102*b* are, respectively, in the neutral and forward drive positions, the shift states of the right and left outboard motors 301 and 302 are, respectively, neutral (N) and forward drive (F). In this case, since a forward drive propulsive force is applied only on the left side of the hull 100 as shown in (A1) of FIG. 6, the behavior of the hull 100 is a right-forward turning motion. In this case, the steering angle of the left outboard motor 302 that generates a propulsive force is changed to be about +10 degrees, for example, so as to follow the right-forward turning direction of the hull 100. The steering angle of the right outboard motor 301 is kept at 0 degrees. Similarly, as indicated by (A2) in FIG. 7, when the right and left operation levers 102*a* and 102*b* are, respectively, in the forward drive and neutral positions, the steering angle of the right outboard motor 301 that generates a propulsive force is changed to be about −10 degrees, for example, so as to follow the left-forward turning direction of the hull 100. The steering angle of the left outboard motor 302 is kept at 0 degrees. It is noted that the steering angle takes a positive value when the rear end portions (propellers 307) of the outboard motors 301 and 302 are turned rightward with respect to the longitudinal direction of the hull 100, while taking a negative value when turned leftward.

As indicated by (B1) in FIG. 7, when the right and left operation levers 102*a* and 102*b* are, respectively, in the neutral and reverse drive positions, the shift states of the right and left outboard motors 301 and 302 are, respectively, neutral (N) and reverse drive (R). In this case, since a reverse drive propulsive force is applied only on the left side of the hull 100 as shown in (B1) of FIG. 6, the behavior of the hull 100 is a right-backward turning motion. In this case, the steering angle of the left outboard motor 302 that generates a propulsive force is changed to be about +10 degrees, for example, so as to follow the right-backward turning direction of the hull 100. The steering angle of the right outboard motor 301 is kept at 0 degrees. Similarly, as indicated by (B2) in FIG. 7, when the right and left operation levers 102*a* and 102*b* are, respectively, in the reverse drive and neutral positions, the steering angle of the right outboard motor 301 that generates a propulsive force is changed to be about −10 degrees, for example, so as to follow the left-backward turning direction of the hull 100. The steering angle of the left outboard motor 302 is kept at 0 degrees.

Also, as indicated by (C1) in FIG. 7, when the right and left operation levers 102*a* and 102*b* are, respectively, in the reverse and forward drive positions, the shift states of the right and left outboard motors 301 and 302 are, respectively, reverse drive (R) and forward drive (F). In this case, since a forward drive propulsive force is applied on the left side of the hull 100 and a reverse drive propulsive force is applied on the right side of the hull 100 as shown in (C1) of FIG. 6, the behavior of the hull 100 is a rightward pivoting motion about the stern of the hull 100. In this case, the steering angle of the left outboard motor 302 is changed to be about +10 degrees, for example, so as to follow the rightward pivoting direction of the hull 100 and the steering angle of the right outboard motor 301 is changed to be about −10 degrees, for example, so as to follow the rightward pivoting direction of the hull 100. Similarly, as indicated by (C2) in FIG. 7, when the right and left operation levers 102*a* and 102*b* are, respectively, in the forward and reverse drive positions, the steering angle of the left outboard motor 302 is changed to be about +10 degrees, for example, so as to follow the leftward pivoting direction of the hull 100 and the steering angle of the right outboard motor 301 is changed to be about −10 degrees, for example, so as to follow the leftward pivoting direction of the hull 100. That is, when the right and left operation levers 102*a* and 102*b* are, respectively, in one and the other of the forward and reverse drive positions, the steering angles of the right and left outboard motors 301 and 302 are changed such that the rear end portions of the right and left outboard motors 301 and 302 are brought close to each other.

The vector directions of the propulsive forces generated by the right and left outboard motors 300 do not include the rotational center of the hull 100 (that approximately coincides with the center of gravity of the hull 100, for example). Therefore, the propulsive forces generated by the right and left outboard motors 300 apply a moment about a vertical axis to the hull 100. This causes the hull 100 to pivot with little displacement.

Further, as shown in (D) of FIG. 6, the hull 100 can move laterally by combining the operations of the patterns (A1), (A2), (B1), (B2), (C1), and (C2). For example, the hull 100 can move leftward by repeating the operations (A1) and (B1) alternately. In this case, the operation (A1) causes the stern of the hull 100 to move leftward and the operation (B1) causes the stem of the hull 100 to move leftward. Since the resistance from water that the hull 100 undergoes is different between forward drive and reverse drive, performing the operation (A1) and then (B1) causes the stem of the hull 100 to pivot leftward with little displacement of the stern. This allows the hull 100 to move leftward laterally. Also, the hull 100 can move rightward laterally by repeating the operations of the patterns (A2) and (B2) alternately as shown in FIG. 7. The hull 100 can move laterally in any direction by combining these leftward and rightward drives and the pivoting operation (C1) and/or (C2).

In the first preferred embodiment, the amount of change in the steering angle of a turned outboard motor 300 is preferably fixed at about 10 degrees, for example, regardless of the amount of displacement of the corresponding operation lever with respect to the neutral position (i.e., throttle opening degree). In the marine vessel propulsion system adopting two outboard motors 300, when the steering angles of the right and left outboard motors 301 and 302 are changed by, for example, about 13 degrees or more so that the rear end portions thereof are brought close to each other, the right and left outboard motors 301 and 302 interfere with each other. Accordingly, the amount of change in the steering angle of each outboard motor 300 is preferably set to about 12 degrees or less, for example.

Figure 8:
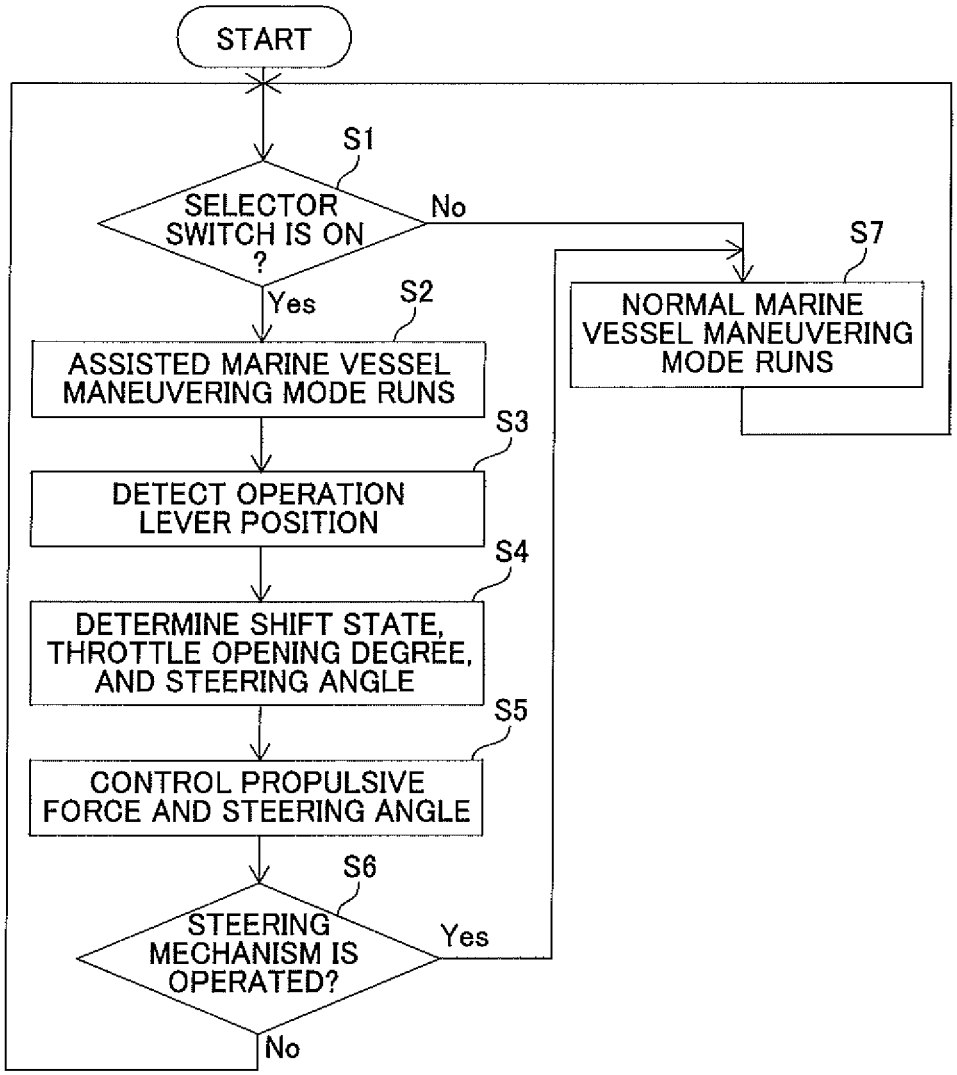
FIG. 8 is a flow chart illustrating the control of the marine vessel propulsion system.

Next will be described the operational control for the marine vessel propulsion system according to the first preferred embodiment of the present invention with reference to FIGS. 7 and 8.

In Step S1, the hull ECU 104 determines whether or not the selector switch 105 is ON. If the selector switch 105 is OFF, the routine goes to Step S7 and the control under the normal marine vessel maneuvering mode is performed. On the other hand, if the selector switch 105 is ON, the control under the assisted marine vessel maneuvering mode is performed in Step S2.

In the normal marine vessel maneuvering mode, the hull ECU 104 determines the shift states and throttle opening degrees of the right and left outboard motors 301 and 302 based on positional information of the operation levers detected by the lever position sensors 102*c* and 102*d*. These determined shift states and throttle opening degrees are sent to the outboard motor ECUs 308. The outboard motor ECUs 308 control the motors 303*a* and 305*a* based on the received shift information and throttle opening degrees to drive the throttle valve 303*b* and the forward-reverse switching mechanism 305. The hull ECU 104 also determines the steering angles of the right and left outboard motors 301 and 302 based on a steering angle detected by the steering angle sensor 103*a*, and sends the determined steering angle data to the steering ECUs 201*c* and 202*c*. The steering ECUs 201*c* and 202*c* drive the motors 201*a* and 202*a* in the respective right and left steering units 201 and 202 to make actual rudder angles detected by the respective actual rudder angle sensors 201*b* and 202*b* to equal to the received steering angles.

On the other hand, in the assisted marine vessel maneuvering mode, the lever position sensors 102*c* and 102*d* detect the positions of the respective operation levers (right operation lever 102*a* and left operation lever 102*b*) in Step S3. The positional information of the operation levers is sent from the lever position sensors 102*c* and 102*d* to the hull ECU 104. Then, in Step S4, the hull ECU 104 determines the shift states, throttle opening degrees, and steering angles of the right and left outboard motors 301 and 302 based on the received positional information of the operation levers and the relationship shown in FIG. 7.

Next, in Step S5, the hull ECU 104 sends the determined shift states and throttle opening degrees to the outboard motor ECUs 308 in the right and left outboard motors 301 and 302. The outboard motor ECUs 308 drive the motor 305*a* for the forward-reverse switching mechanism 305 and the motor 303*a* for the throttle valve 303*b* to achieve the received shift states and throttle opening degrees. The hull ECU 104 also sends the determined steering angles to the steering ECUs 201*c* and 202*c* in the respective right and left steering units 201 and 202. The steering ECUs 201*c* and 202*c* drive the motors 201*a* and 202*a* in the respective right and left steering units 201 and 202 to make actual rudder angles detected by the respective actual rudder angle sensors 201*b* and 202*b* to equal to the received steering angles.

In Step S6, the hull ECU 104 determines whether or not the steering mechanism 103 is operated based on a detection result from the steering angle sensor 103*a*. If the steering mechanism 103 is rotated by a predetermined angle or more, the hull ECU 104 determines that the steering mechanism 103 is operated by the operator, and the routine proceeds to Step S7 to switch to the control under the normal marine vessel maneuvering mode. If the steering mechanism 103 is not rotated by the predetermined angle or more, the hull ECU 104 determines that the steering mechanism 103 is not operated by the operator, and the routine returns to Step S1. Steps S1 to S7 will thereafter be repeated.

In the assisted marine vessel maneuvering mode, not only the shift states and propulsive forces but also the steering angles of the right and left outboard motors 301 and 302 are controlled based on detection results from the two lever position sensors 102*c* and 102*d*, as described above. More specifically, the steering angles of the right and left outboard motors 301 and 302 are changed to facilitate the behavior of the hull 100 corresponding to the shift states and propulsive forces of the right and left outboard motors 301 and 302. This allows the propulsive forces of the outboard motors 300 to act effectively on the hull 100. This allows the hull 100 to have a smaller turning radius. It is further possible to change the behavior of the hull 100 quickly. As a result, the movement of the marine vessel can be controlled finely. In addition, since the marine vessel can be controlled only by operating the operation levers (right operation lever 102*a* and left operation lever 102*b*), there is no need to operate the steering mechanism 103. It is therefore possible to improve the operability when finely controlling the movement of the marine vessel. Since the marine vessel can be controlled only by operating the operation levers, there is also no need to provide another operation system such as a cross-shaped key separately from the operation levers, which can prevent the marine vessel propulsion system from having a complex structure as well as the operations being complicated.

Also, in the assisted marine vessel maneuvering mode, the shift states and propulsive forces of the outboard motors 300 are controlled such that the positions of the operation levers correspond to the shift states and the throttle opening degrees. Therefore, the positions of the respective right and left operation levers 102*a* and 102*b* correspond to the shift states of the respective right and left outboard motors 301 and 302. Thus, the operator can recognize in which direction a propulsive force is applied to the hull 100 while he or she operates the operation levers. This allows the operator to easily imagine the behavior of the marine vessel, such as turning motion and pivoting motion, caused by operating the operation levers. In addition, controlling the steering angle allows the propulsive forces of the outboard motors 300 to act in the direction of the movement of the hull 100. It is therefore possible to achieve the behavior of the marine vessel quickly and highly responsively as the operator imagines. As a result, the operability of the marine vessel by the operator can be further improved.

Further, in the assisted marine vessel maneuvering mode, when the positions of the respective right and left operation levers 102*a* and 102*b* are different from each other, the steering angles of the outboard motors 300 are changed to promote the behavior of the hull 100 corresponding to the shift states and propulsive forces of the right and left outboard motors 301 and 302. With this arrangement, when the operator operates the right and left operation levers 102*a* and 102*b* to be their respective different positions to turn the hull 100, the hull 100 can be turned with a small turning radius, and it is also possible to change the behavior of the hull 100 quickly and highly responsively.

Furthermore, in the assisted marine vessel maneuvering mode, when the right and left operation levers 102*a* and 102*b* are, respectively, in the forward and reverse drive positions, the steering angles of the right and left outboard motors 301 and 302 are changed such that the rear end portions of the respective outboard motors 301 and 302 are brought close to each other. This causes the hull 100 to pivot. This arrangement allows the propulsive forces of the right and left outboard motors 301 and 302 to act in the pivoting direction of the hull. That is, the hull 100 can be applied with a propulsive force in a direction deviated from the rotational center of the hull 100. This allows the hull 100 to rotate (pivot) quickly without being largely displaced (substantially with no displacement).

Also, in the assisted marine vessel maneuvering mode, as described above, a certain amount of change in the steering angle of each outboard motor 300 is maintained regardless of the amount of displacement of each operation lever with respect to the neutral position. This allows the change in the behavior (speed) of the hull 100 to be adjusted in faithful accordance with the amount of control of each operation lever.

Moreover, in the first preferred embodiment, the selector switch 105 is arranged to switch control modes between the normal marine vessel maneuvering mode and the assisted marine vessel maneuvering mode, as described above. With this arrangement, the operator can run the normal marine vessel maneuvering mode and use the steering mechanism 103 for normal marine vessel maneuvering. On the other hand, the operator, when required to finely control the movement of the marine vessel (such as launching from and docking on shore), can run the assisted marine vessel maneuvering mode and use only the operation levers for maneuvering. This can improve the convenience for the operator.

The above-described advantageous effects of the marine vessel propulsion system according to the first preferred embodiment of the present invention will hereinafter be described in more detail with reference to FIGS. 9 to 12. In the following descriptions, the behavior of the marine vessel propulsion system in the normal marine vessel maneuvering mode, in which the steering angles of the outboard motors 300 are not controlled using the operation levers, are shown in a manner comparable with those in the assisted marine vessel maneuvering mode.

Figure 9:
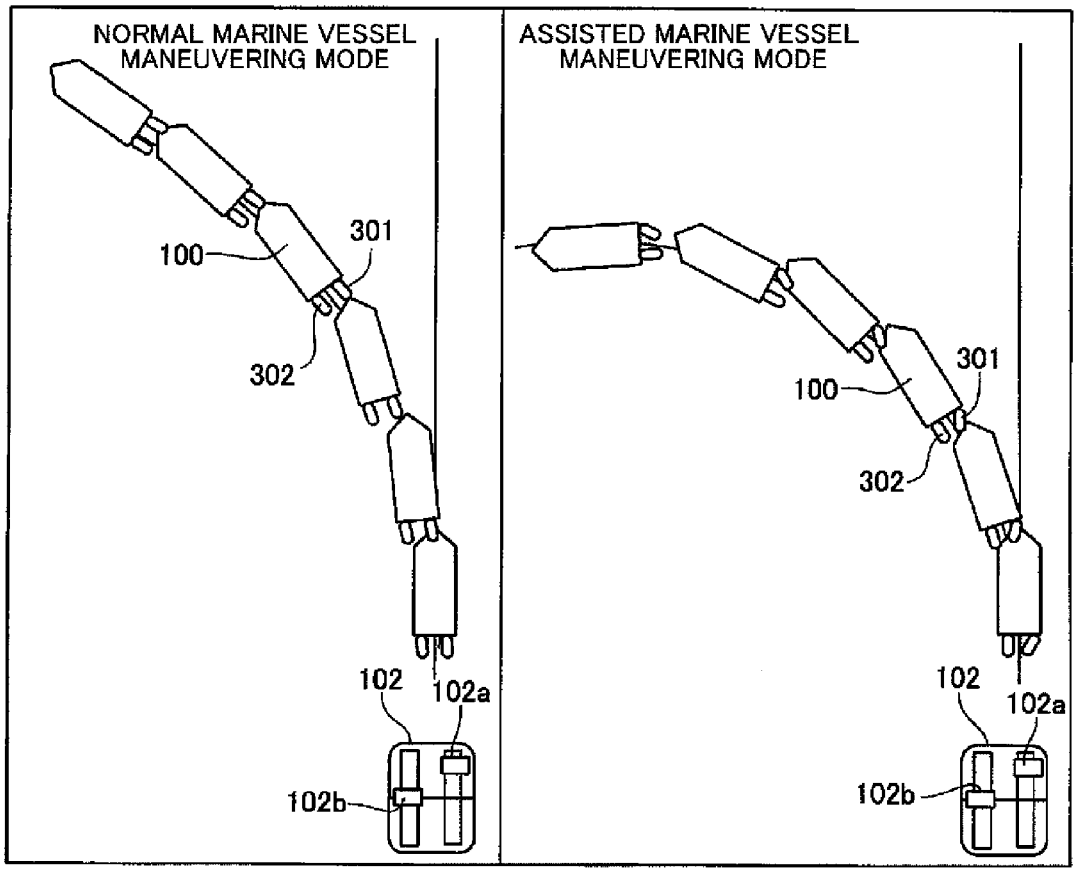
FIGS. 9 to 12 illustrate advantageous effects of the marine vessel propulsion system.

FIG. 9 shows the behavior of the hull 100 when turned only by operating the operation levers under the assisted and normal marine vessel maneuvering modes according to the first preferred embodiment. As shown in FIG. 9, in the normal marine vessel maneuvering mode, since the turning direction is different from the direction in which the propulsive forces of the outboard motors 300 are applied, the turning speed is low. This results in a larger turning radius in the normal marine vessel maneuvering mode. On the other hand, in the assisted marine vessel maneuvering mode, since the propulsive forces of the outboard motors 300 are applied in the turning direction, the turning speed is high to result in a smaller turning radius.

Figure 10:
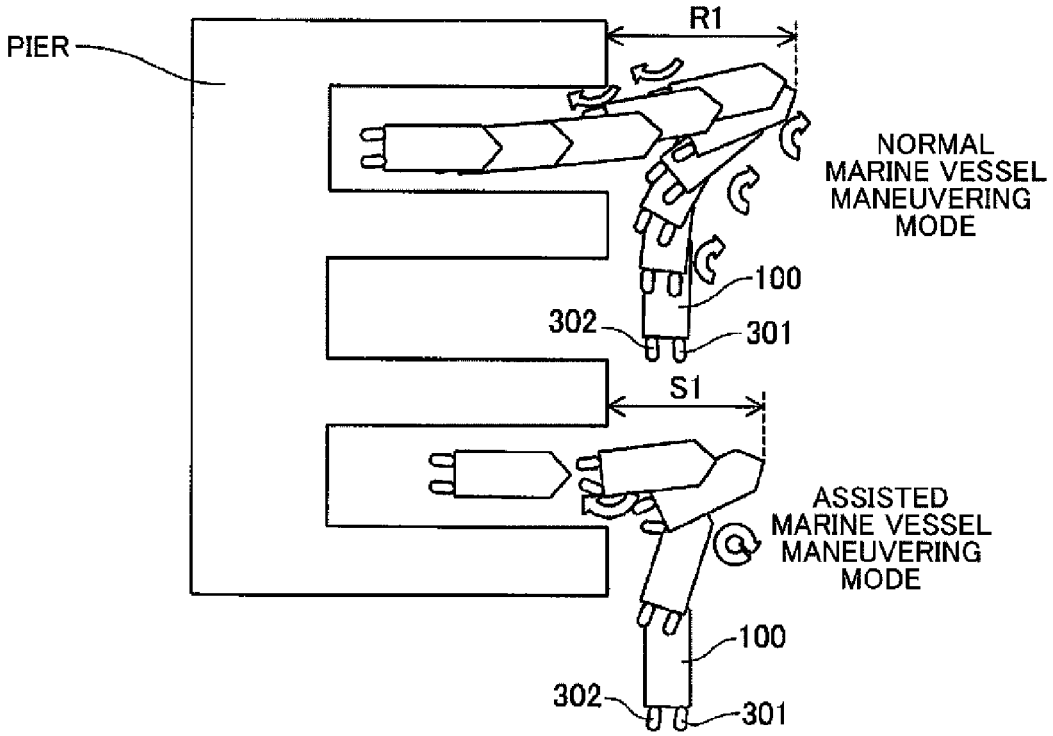

FIG. 10 shows the behavior of the hull 100 when put between piers only by operating the operation levers under the assisted and normal marine vessel maneuvering modes. As shown in FIG. 10, in the normal marine vessel maneuvering mode, the hull 100 cannot be turned in a small radius due to its low turning speed and pivoting speed, which requires a larger space R1 to put the marine vessel between the piers. On the other hand, in the assisted marine vessel maneuvering mode, the turning speed and pivoting speed are both high, which requires only a smaller space S1 to put the marine vessel between the piers.

Figure 11:
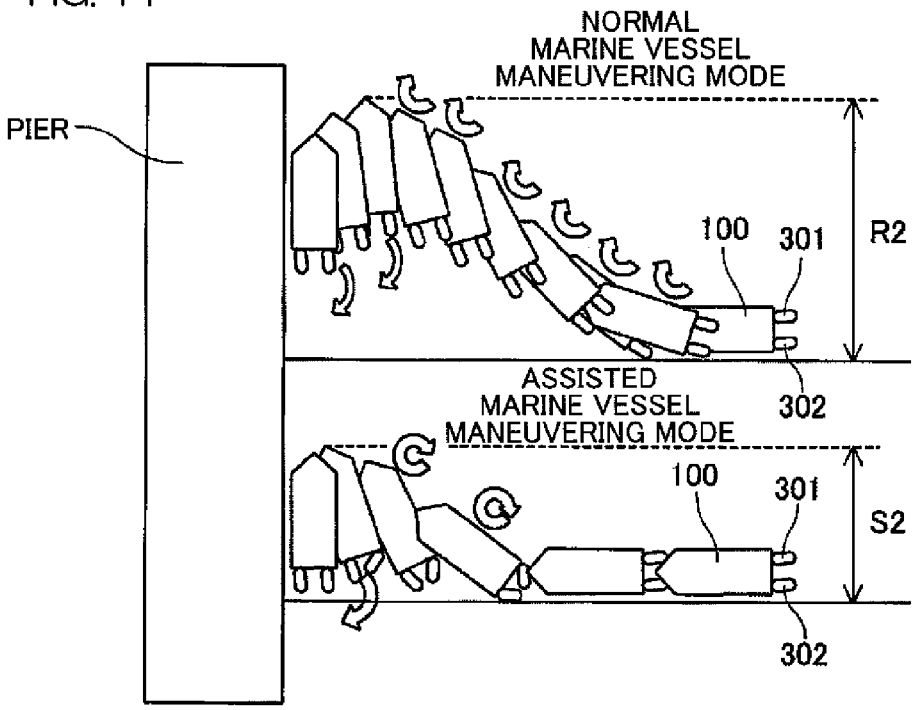

FIG. 11 shows the behavior of the hull 100 when brought alongside a pier under the assisted and normal marine vessel maneuvering modes. As shown in FIG. 11, in the normal marine vessel maneuvering mode, the hull 100 cannot be turned in a small radius due to its low turning speed and pivoting speed, which requires a larger space R2 to bring the marine vessel alongside the pier. On the other hand, in the assisted marine vessel maneuvering mode, the turning speed and pivoting speed are both high, which requires only a smaller space S2 to bring the marine vessel alongside the pier.

Figure 12:
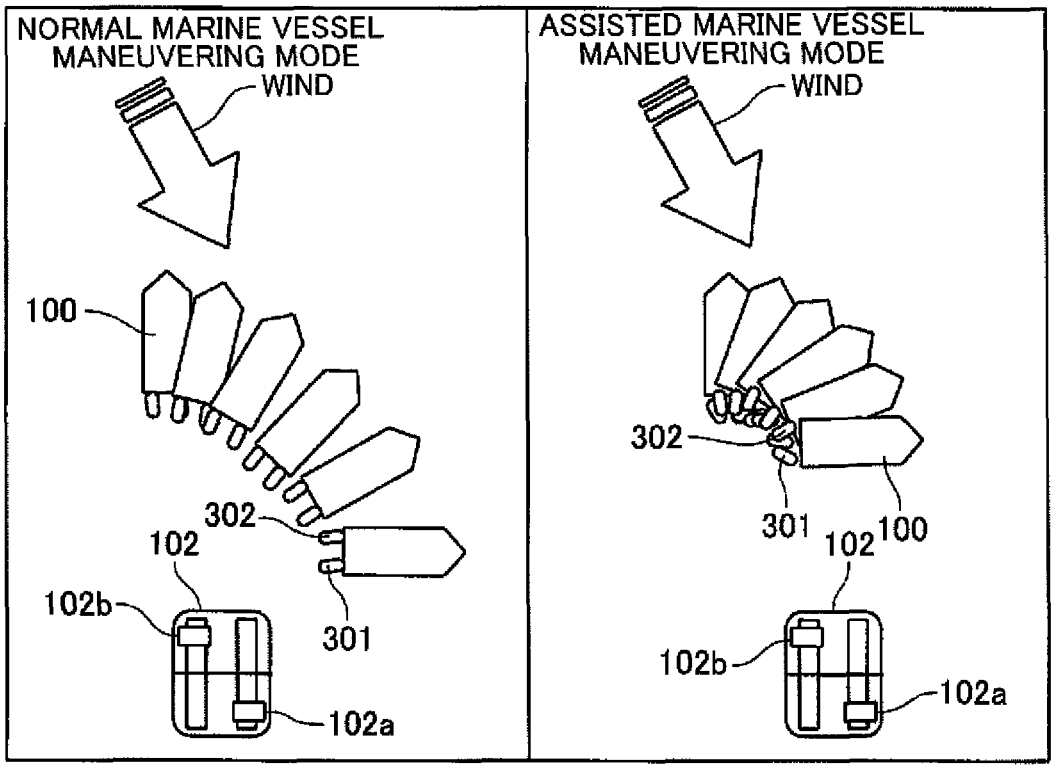

FIG. 12 shows the behavior of the hull 100 when pivoting only by operating the operation levers under the assisted and normal marine vessel maneuvering modes with the wind from a certain direction. The hull 100 is required to move faster under the wind. As shown in FIG. 12, in the normal marine vessel maneuvering mode, since the pivoting direction is different from the direction in which the propulsive forces of the outboard motors 300 are applied, the pivoting speed is low. For this reason, the hull 100 is displaced largely by the wind during pivoting. On the other hand, in the assisted marine vessel maneuvering mode, since the propulsive forces of the outboard motors 300 are applied in the pivoting direction, the pivoting speed is high. For this reason, the hull 100 is less likely to be displaced during pivoting.

Second Preferred Embodiment

Figure 13:
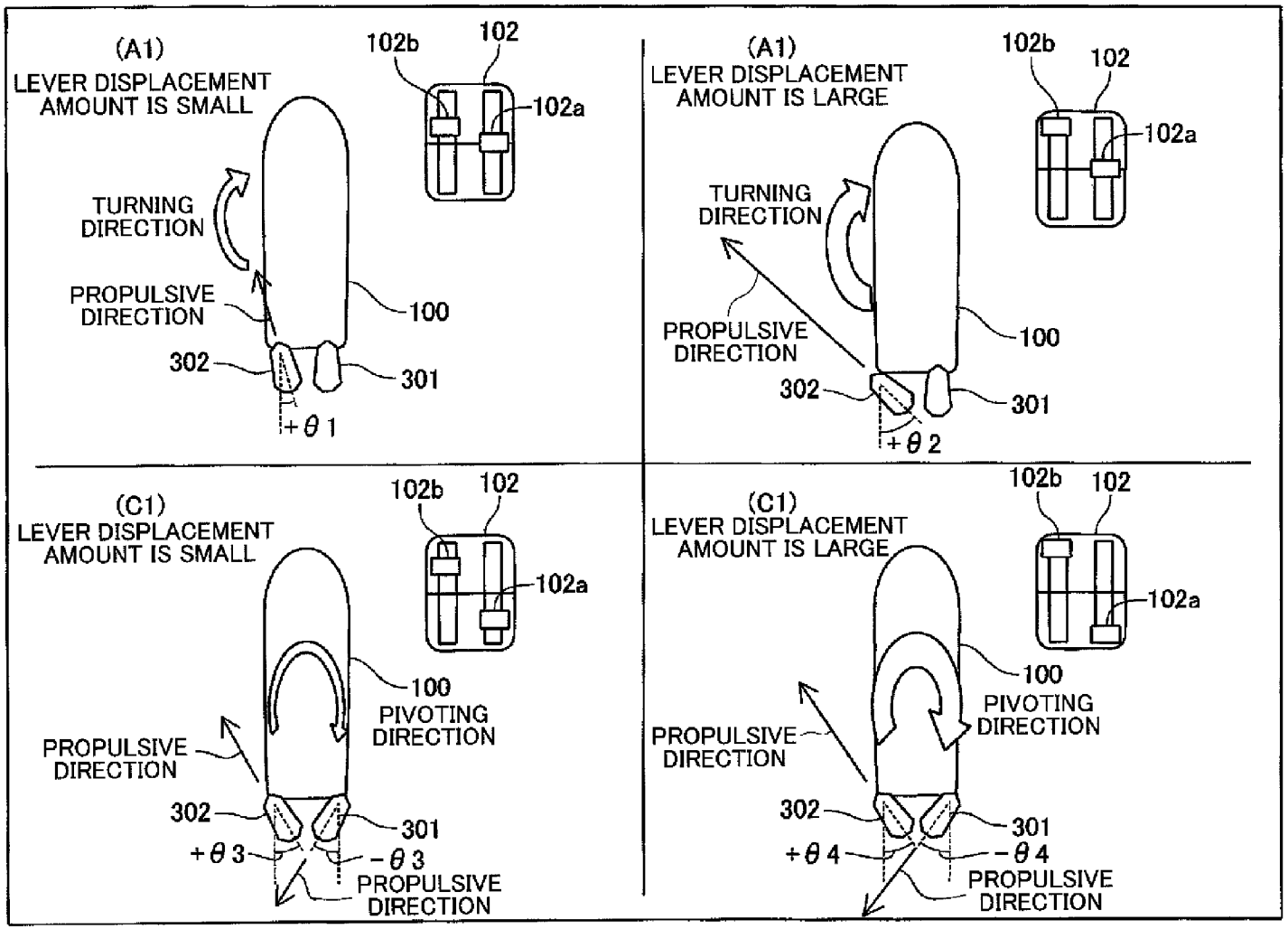
FIG. 13 illustrates steering angle control when a marine vessel propulsion system according to a second preferred embodiment of the present invention is in an assisted marine vessel maneuvering mode.
Figure 15:
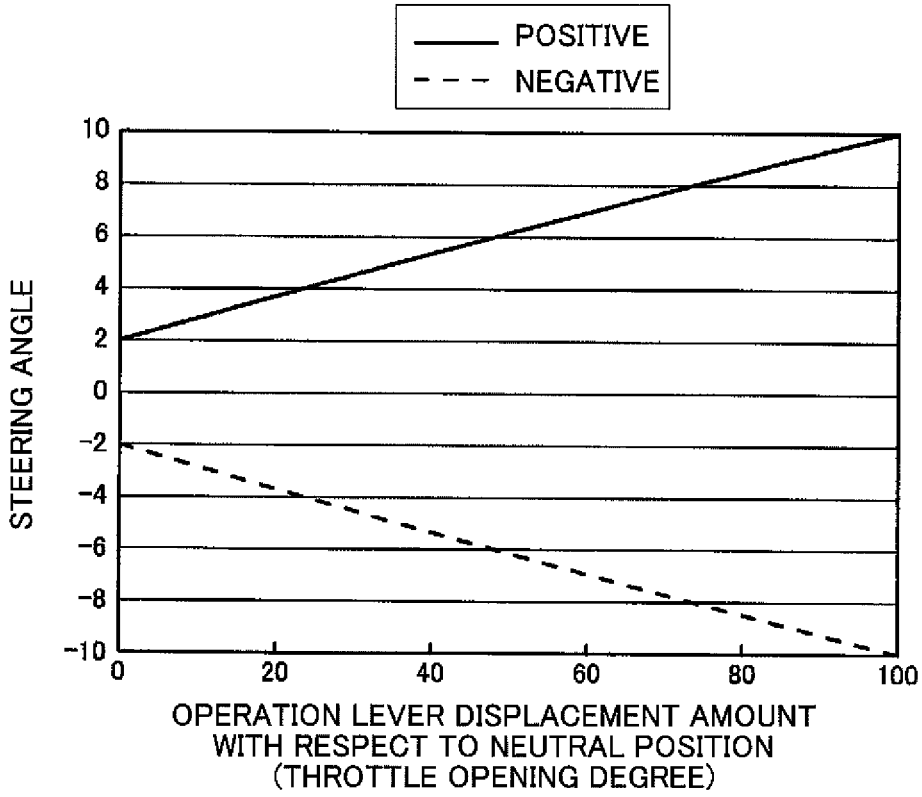
FIG. 15 shows the relationship between the amount of displacement of each operation lever and the steering angle when the marine vessel propulsion system according to the second preferred embodiment is in the assisted marine vessel maneuvering mode.

Referring now to FIGS. 13 to 15, in the second preferred embodiment, the amount of change in the steering angle of each outboard motor 300 is changed according to the amount of displacement of each operation lever with respect to the neutral position. The structures of the components other than the hull ECU 104 in the marine vessel propulsion system according to the second preferred embodiment are substantially the same as those in the above-described first preferred embodiment, so that descriptions of the structures of the components other than the hull ECU will be omitted.

In the second preferred embodiment, as shown in FIG. 14, the steering angles of the outboard motors 300 are changed based on one of the patterns (A1), (A2), (B1), (B2), (C1), and (C2), as is the case in the first preferred embodiment. It will be appreciated that two or more of the patterns (A1), (A2), (B1), (B2), (C1), and (C2) in FIG. 14 may be combined arbitrarily and used sequentially in actual marine vessel maneuvering.

In the second preferred embodiment, the amount of change in the steering angle of each outboard motor 300 is changed according to the amount of displacement of each operation lever with respect to the neutral position (i.e., throttle opening degree command).

For example, in the pattern (A1), the right and left operation levers 102*a* and 102*b* are, respectively, in the neutral and forward drive positions. In the pattern (A1), the steering angle of the left outboard motor 302 is changed according to the amount of displacement of the left operation lever 102*b*. As shown in FIG. 13, if the amount of displacement of the left operation lever 102*b* is small (i.e., the throttle opening degree of the left outboard motor 302 is small), the amount of change θ1 in the steering angle of the left outboard motor 302 is also small. On the contrary, if the amount of displacement of the left operation lever 102*b* is large (i.e., the throttle opening degree of the left outboard motor 302 is large), the amount of change θ2 in the steering angle of the left outboard motor 302 is also large.

In the pattern (C1), the right and left operation levers 102*a* and 102*b* are, respectively, in the reverse and forward drive positions. In the pattern (C1), the steering angles of the right and left outboard motors 301 and 302 are changed according to the amounts of displacement of the respective right and left operation levers 102*a* and 102*b*. As shown in FIG. 13, if the amounts of displacement of the right and left operation levers 102*a* and 102*b* are small, the amounts of change θ3 in the steering angles of the right and left outboard motors 301 and 302 are also small. On the contrary, if the amounts of displacement of the right and left operation levers 102*a* and 102*b* are large, the amounts of change θ4 in the steering angles of the right and left outboard motors 301 and 302 are also large.

In the second preferred embodiment, the amount of displacement of each operation lever (i.e., throttle opening degree command) is proportional to the amount of change in the steering angle of each outboard motor 300. Specifically, as shown in FIG. 15, the steering angle of each outboard motor 300 changes from, for example, about 2 degrees to about 10 degrees (about 2 or more but about 10 or less degrees or about −10 or more but about −2 or less degrees) while the throttle opening degree changes from 0 to 100% (0 or more but 100 or less %).

Thus, in the second preferred embodiment, the amount of change in the steering angle of each outboard motor 300 is changed according to the amount of displacement of each operation lever with respect to the neutral position (i.e., throttle opening degree command). With this arrangement, the amount of change in the steering angle of each outboard motor 300 can be increased by increasing the amount of operation of each operation lever. This allows a turning or pivoting force to act more forcefully on the hull 100 when the amount of operation of each operation lever is increased. This allows the hull 100 to have a smaller turning radius and it is also possible to change the behavior of the hull 100 more quickly and highly responsively.

Other advantages of the second preferred embodiment are substantially the same as those of the above-described first preferred embodiment.

Third Preferred Embodiment

A third preferred embodiment of the present invention will be described with reference to FIGS. 16 and 17. In the third preferred embodiment, the hull 100 moves laterally when the right and left operation levers 102*a* and 102*b* are, respectively, in the forward and reverse drive positions. The structures of the components other than the hull ECU in the marine vessel propulsion system according to the third preferred embodiment are substantially the same as those in the above-described first preferred embodiment, so that descriptions of the structures of the components other than the hull ECU will be omitted.

In the third preferred embodiment, as shown in FIG. 17, when one of the right and left operation levers 102*a* and 102*b* is in the neutral position, the steering angles of the outboard motors 300 are changed based on one of the patterns (A1), (A2), (B1), and (B2), as is the case in the first preferred embodiment. However, when the right and left operation levers 102*a* and 102*b* are, respectively, in the forward and reverse drive positions, the steering angles of the outboard motors 300 are controlled such that the hull 100 moves laterally, unlike the first preferred embodiment.

Figure 16:
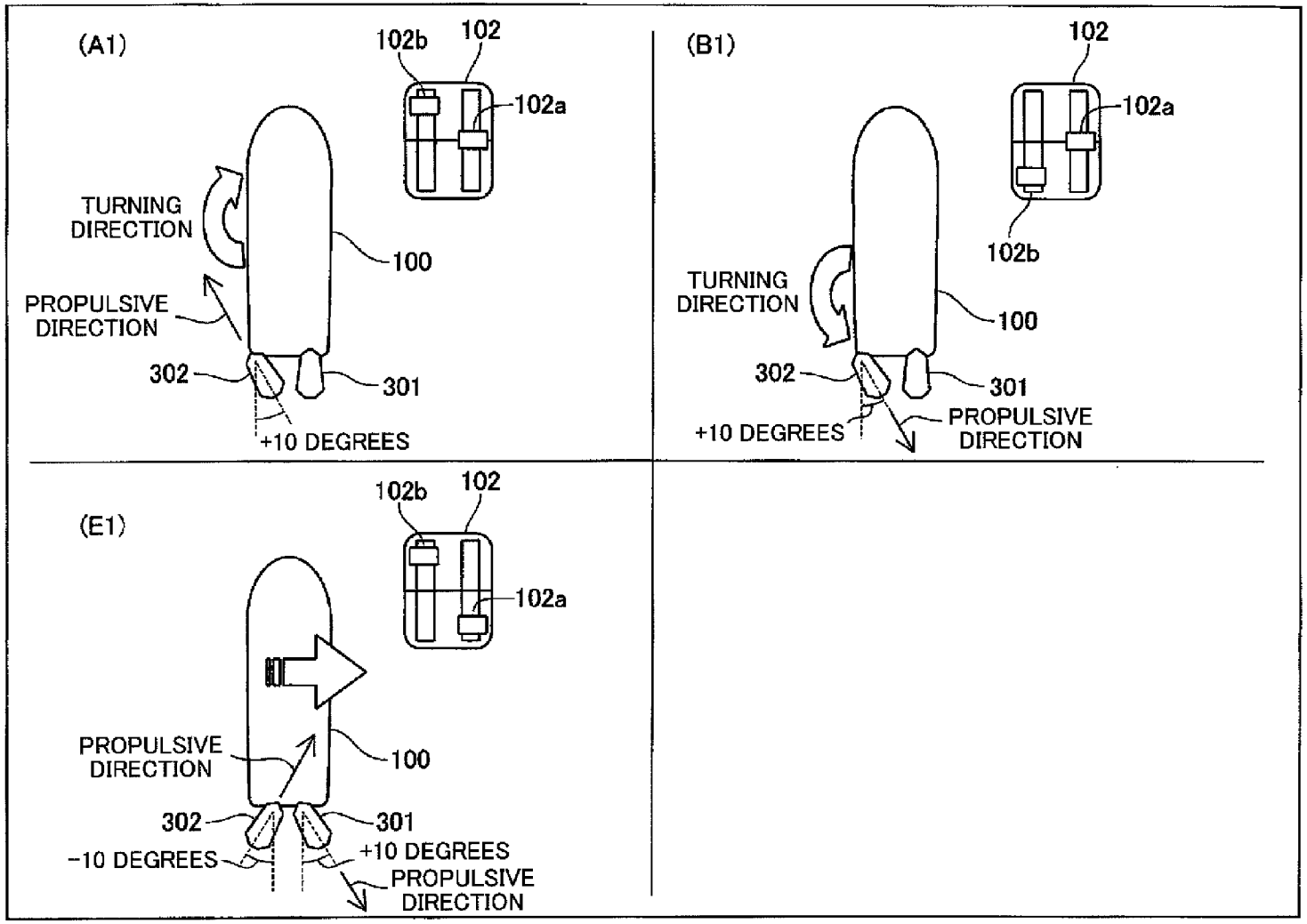
FIG. 16 illustrates steering angle control when a marine vessel propulsion system according to a third preferred embodiment of the present invention is in an assisted marine vessel maneuvering mode.

For example, as shown in FIG. 16 and indicated by (E1) in FIG. 17, when the right and left operation levers 102*a* and 102*b* are, respectively, in the reverse and forward drive positions, the steering angle of the right outboard motor 301 is changed to be about +10 degrees and the steering angle of the left outboard motor 302 is changed to be about −10 degrees, for example. Similarly, as indicated by (E2) in FIG. 17, also when the right and left operation levers 102*a* and 102*b* are, respectively, in the forward and reverse drive positions, the steering angle of the right outboard motor 301 is changed to be about +10 degrees and the steering angle of the left outboard motor 302 is changed to be about −10 degrees, for example. That is, when the positional combination of the right and left operation levers 102*a* and 102*b* includes the forward and reverse drive positions, the steering angles of the right and left outboard motors 301 and 302 are changed such that the rear end portions of the right and left outboard motors 301 and 302 are moved away from each other. In this case, the propulsive force vectors of the right and left outboard motors 301 and 302 are both directed to the rotational center of the hull 100. This causes the hull 100 to move laterally with little pivoting. More specifically, in the pattern (E1) shown in FIG. 16, the resultant force of the propulsive forces of the right and left outboard motors 301 and 302 causes the hull 100 to move rightward. Similarly, in the pattern (E2) shown in FIG. 17, the resultant force of the propulsive forces of the right and left outboard motors 301 and 302 causes the hull 100 to move leftward.

Figure 18:
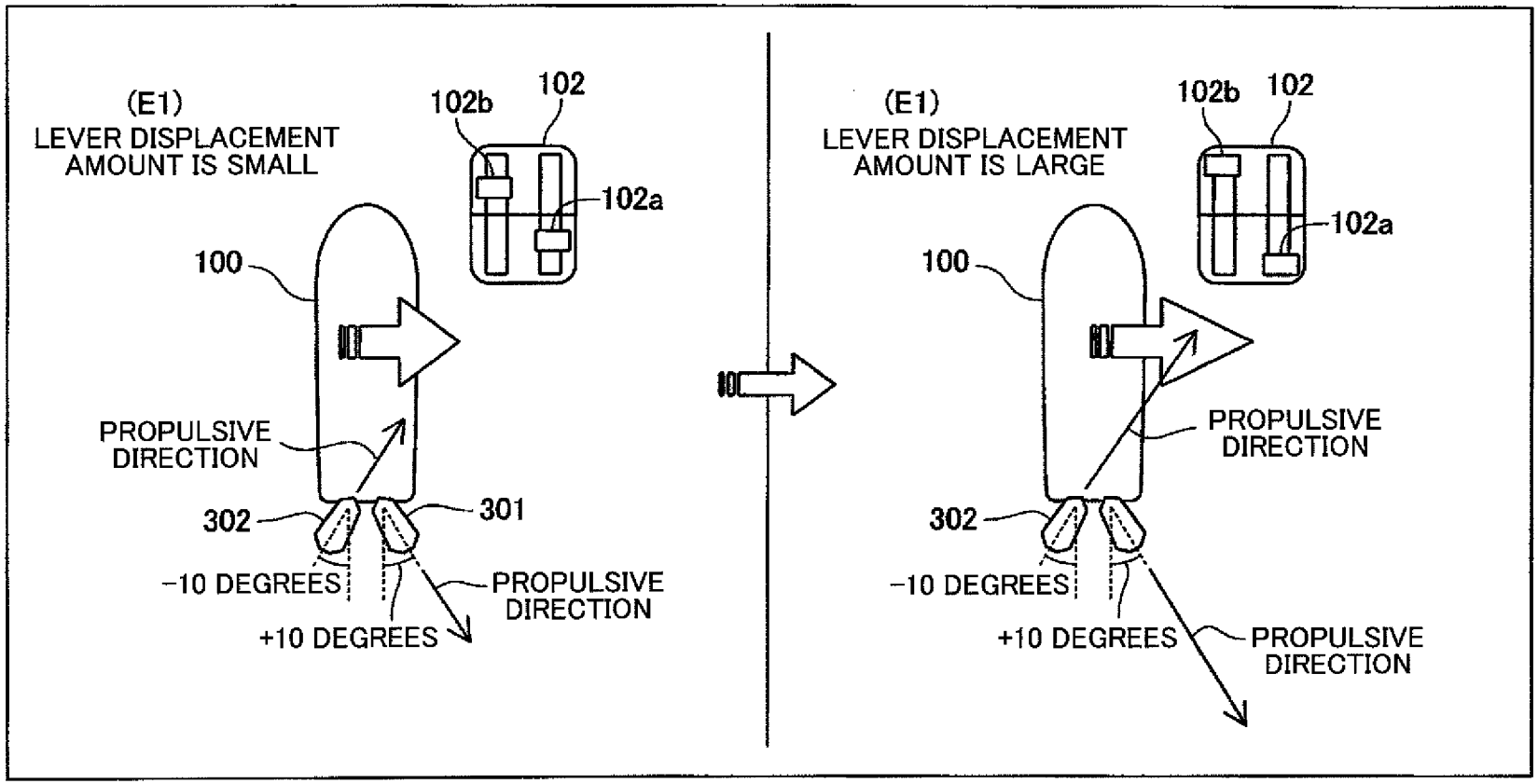
FIG. 18 illustrates the change in the lateral movement speed when the marine vessel propulsion system according to the third preferred embodiment is in the assisted marine vessel maneuvering mode.
Figure 19:
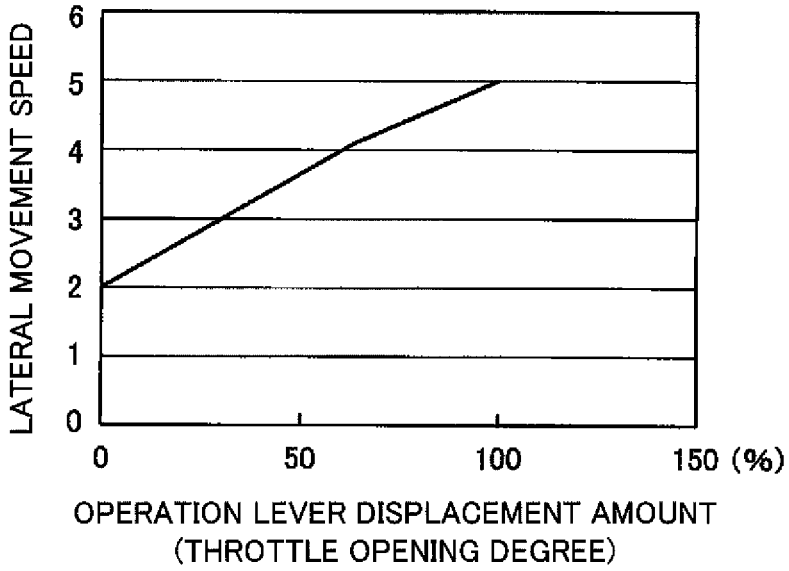
FIG. 19 shows the change in the lateral movement speed when the marine vessel propulsion system according to the third preferred embodiment is in the assisted marine vessel maneuvering mode.

In the third preferred embodiment, the lateral movement speed of the hull 100 can be changed by changing the amount of displacement of each operation lever, as shown in FIGS. 18 and 19. That is, if the amount of displacement of each operation lever is small, the propulsive force of the corresponding outboard motor 300 (right outboard motor 301 and left outboard motor 302) is also small to result in a lower movement speed. On the contrary, if the amount of displacement of each operation lever is large, the propulsive force of the corresponding outboard motor 300 (right outboard motor 301 and left outboard motor 302) is also large to result in a higher movement speed.

Thus, in the third preferred embodiment, the hull 100 can move laterally with the propulsive forces of the right and left outboard motors 301 and 302 without using a side thruster.

Other advantages of the third preferred embodiment are substantially the same as those of the above-described first preferred embodiment.

Fourth Preferred Embodiment

A fourth preferred embodiment of the present invention will be described with reference to FIG. 20. In the fourth preferred embodiment, the hull 100 moves laterally when the positional combination of the right and left operation levers 102*a* and 102*b* includes the forward and reverse drive positions, unlike the first preferred embodiment. The structures of the components other than the hull ECU 104 in the marine vessel propulsion system according to the fourth preferred embodiment are substantially the same as those in the above-described first preferred embodiment, so that descriptions of the structures of the components other than the hull ECU will be omitted.

In the fourth preferred embodiment, as shown in FIG. 20, the steering angles of the outboard motors 300 are changed based on one of the patterns (A1), (A2), (B1), (B2), (E1), and (E2), as is the case in the third preferred embodiment. In the fourth preferred embodiment, the amount of change in the steering angle of each outboard motor 300 is changed according to the amount of displacement of each operation lever in the patterns (A1), (A2), (B1), and (B2). That is, in the fourth preferred embodiment, the control according to the second preferred embodiment is performed in the patterns (A1), (A2), (B1), and (B2), while the lateral movement control according to the third preferred embodiment is performed in the patterns (E1) and (E2).

Advantages of the fourth preferred embodiment are substantially the same as those of the above-described first to third preferred embodiments.

Fifth Preferred Embodiment

A fifth preferred embodiment of the present invention will be described with reference to FIGS. 21 and 21A. The fifth preferred embodiment describes the case where three outboard motors are mounted on the hull 100, unlike the above-described first preferred embodiment in which two outboard motors are mounted on the hull 100. In FIG. 21A, components identical to those in FIG. 3 are designated by the same reference numerals.

In the fifth preferred embodiment, three outboard motors (right outboard motor 501, center outboard motor 502, and left outboard motor 503) are mounted on the hull 100, respectively, via three steering units 201, 202, and 203. The steering units 201, 202, and 203 include, respectively, motors 201*a*, 202*a*, and 203*a*, actual rudder angle sensors 201*b*, 202*b*, and 203*b*, and steering ECUs 201*c*, 202*c*, and 203*c*. The steering ECUs 201*c*, 202*c*, and 203*c* are arranged to be capable of communicating information with the hull ECU 104 through the LAN 10. The outboard motors 501, 502, and 503 each include a motor 303*a* arranged to drive a throttle valve, a motor 305*a* arranged to drive a forward-reverse switching mechanism, and an outboard motor ECU 308. The outboard motor ECUs 308 are arranged to be capable of communicating information with the hull ECU 104 via the LAN 10.

The shift state and throttle opening degree of the right outboard motor 501 are controlled correspondingly to the position of the right operation lever 102*a*. The shift state and throttle opening degree of the left outboard motor 503 are also controlled correspondingly to the position of the left operation lever 102*b*. The shift state and throttle opening degree of the center outboard motor 502 are controlled based on the positions of the right and left operation levers 102*a* and 102*b*. The hull ECU 104 is arranged, in the assisted marine vessel maneuvering mode, to control the shift states, throttle opening degrees, and steering angles of the three outboard motors based on detection results from the two lever position sensors. In the fifth preferred embodiment, the steering angles of the outboard motors (right outboard motor 501, center outboard motor 502, and left outboard motor 503) are changed to drive the behavior of the hull 100 using substantially the same patterns as in the above-described first preferred embodiment.

Figure 21:
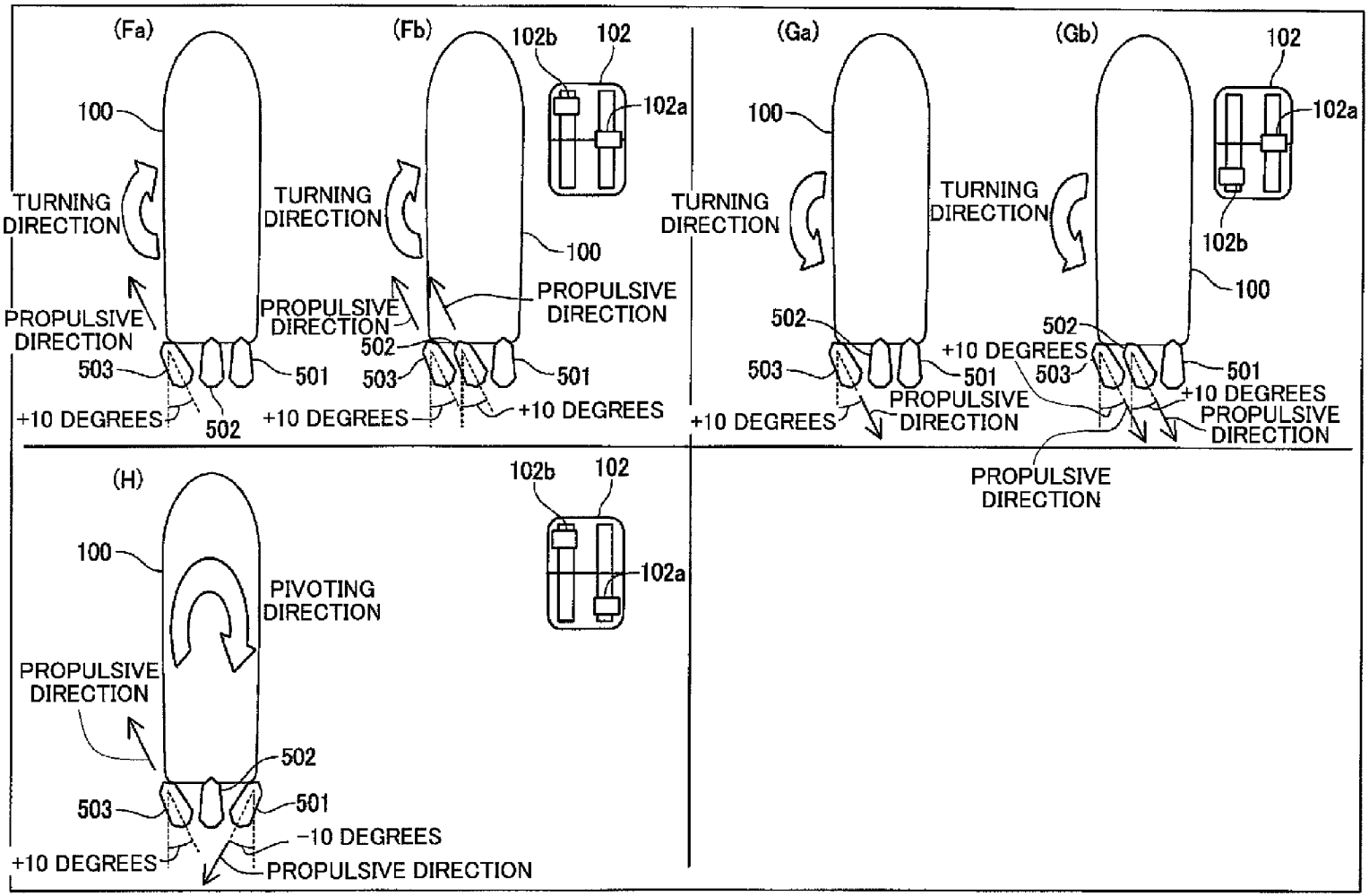
FIG. 21 illustrates steering angle control when a marine vessel propulsion system according to a fifth preferred embodiment of the present invention is in an assisted marine vessel maneuvering mode.
Figure 21A:
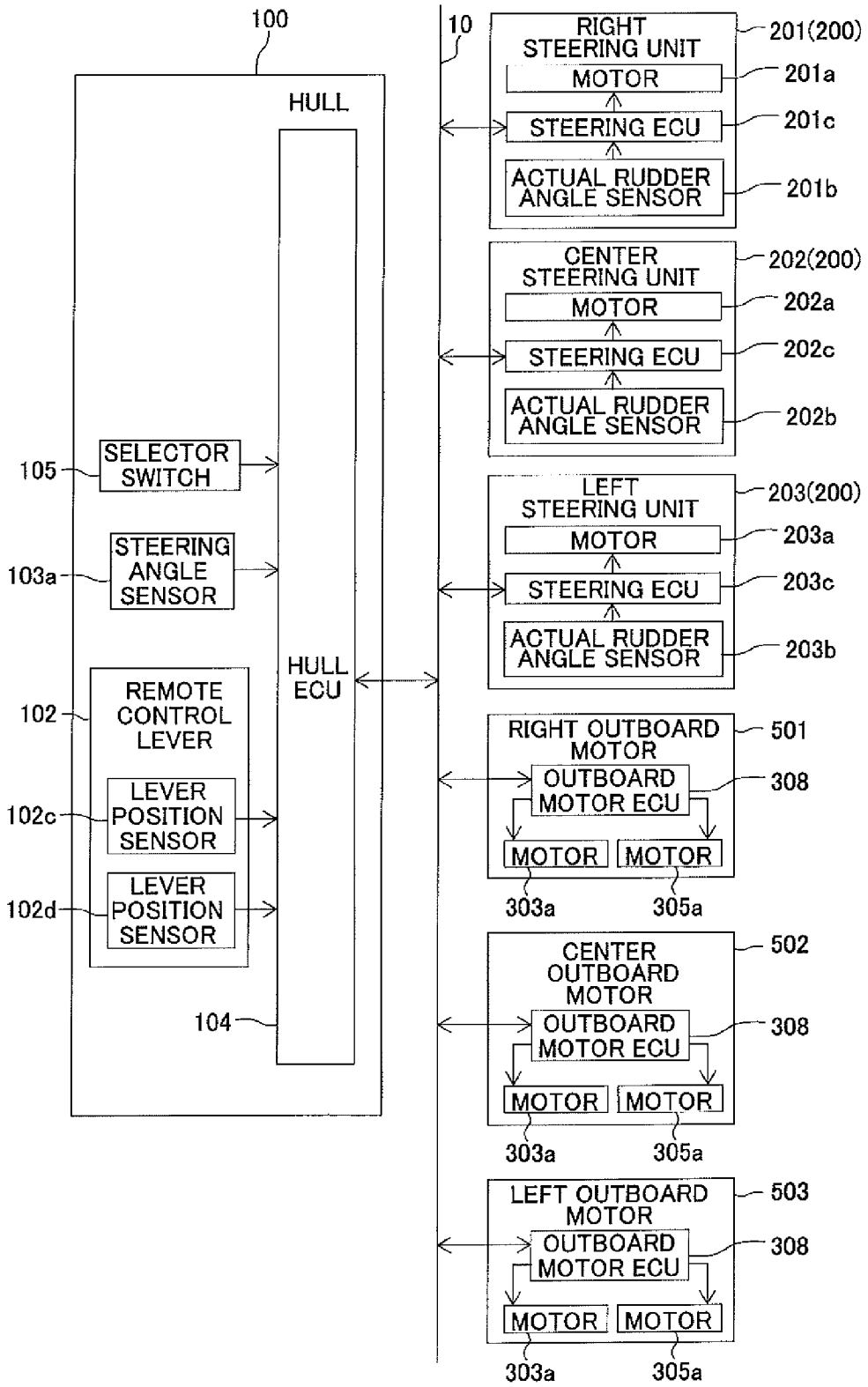
FIG. 21A is a block diagram showing the electrical configuration of the marine vessel propulsion system.

For example, as shown in (Fa) and (Fb) of FIG. 21, when the right and left operation levers 102*a* and 102*b* are, respectively, in the neutral and forward drive positions, the steering angle of the left outboard motor 503 that generates a propulsive force is changed to be about +10 degrees, for example, so as to follow the right-forward turning direction of the hull 100. Since the right outboard motor 501 generates no propulsive force, the steering angle thereof is kept at 0 degrees. Here, when the right and left operation levers 102*a* and 102*b* are, respectively, in the neutral and forward drive positions, the shift state of the center outboard motor 502 may be controlled in the neutral or forward drive state. If the shift state of the center outboard motor 502 is in the neutral state as shown in (Fa) of FIG. 21, the center outboard motor 502 generates no propulsive force. Therefore, the steering angle of the center outboard motor 502 remains unchanged at 0 degrees. If the shift state of the center outboard motor 502 is in the forward drive state as shown in (Fb) of FIG. 21, the center outboard motor 502 also generates a propulsive force. Therefore, the steering angle of the center outboard motor 502 is also changed to be about +10 degrees, for example, so as to follow the right-forward turning direction of the hull 100.

As shown in (Ga) and (Gb) of FIG. 21, when the right and left operation levers 102*a* and 102*b* are, respectively, in the neutral and reverse drive positions, the steering angle of the left outboard motor 503 that generates a propulsive force is changed to be about +10 degrees, for example, so as to follow the right-backward turning direction of the hull 100. Since the right outboard motor 501 generates no propulsive force, the steering angle thereof is kept at 0 degrees. Also, in this case, if the shift state of the center outboard motor 502 is in the neutral state as shown in (Ga) of FIG. 21, the center outboard motor 502 generates no propulsive force. Therefore, the steering angle of the center outboard motor 502 remains unchanged at 0 degrees. If the shift state of the center outboard motor 502 is in the reverse drive state as shown in (Gb) of FIG. 21, the center outboard motor 502 also generates a propulsive force. Therefore, the steering angle of the center outboard motor 502 is also changed to be about +10 degrees so as to follow the right-backward turning direction of the hull 100.

Similarly, when the right and left operation levers 102*a* and 102*b* are, respectively, in the forward drive and neutral positions, the steering angle of the right outboard motor 501 that generates a propulsive force is changed to be about −10 degrees so as to follow the left-forward turning direction of the hull 100. Since the left outboard motor 503 generates no propulsive force, the steering angle thereof is kept at 0 degrees. Here, when the right and left operation levers 102*a* and 102*b* are, respectively, in the forward drive and neutral positions, the shift state of the center outboard motor 502 may be controlled in the neutral or forward drive state. If the shift state of the center outboard motor 502 is in the neutral state, the center outboard motor 502 generates no propulsive force. Therefore, the steering angle of the center outboard motor 502 remains unchanged at 0 degrees. If the shift state of the center outboard motor 502 is in the forward drive state, the center outboard motor 502 also generates a propulsive force. Therefore, the steering angle of the center outboard motor 502 is also changed to be about −10 degrees, for example, so as to follow the left-forward turning direction of the hull 100.

When the right and left operation levers 102*a* and 102*b* are, respectively, in the reverse drive and neutral positions, the steering angle of the right outboard motor 501 that generates a propulsive force is changed to be about −10 degrees, for example, so as to follow the left-backward turning direction of the hull 100. Since the left outboard motor 503 generates no propulsive force, the steering angle thereof is kept at 0 degrees. Also in this case, if the shift state of the center outboard motor 502 is in the neutral state, the center outboard motor 502 generates no propulsive force. Therefore, the steering angle of the center outboard motor 502 remains unchanged at 0 degrees. If the shift state of the center outboard motor 502 is in the reverse drive state, the center outboard motor 502 also generates a propulsive force. Therefore, the steering angle of the center outboard motor 502 is also changed to be about −10 degrees, for example, so as to follow the left-backward turning direction of the hull 100.

Further, as shown in (H) of FIG. 21, when the right and left operation levers 102*a* and 102*b* are, respectively, in the reverse and forward drive positions, the steering angles of the right and left outboard motors 501 and 503 that each generate a propulsive force are changed, respectively, to be about −10 and about +10 degrees so as to follow the rightward pivoting direction of the hull 100. Similarly, when the right and left operation levers 102*a* and 102*b* are, respectively, in the forward and reverse drive positions, the steering angles of the right and left outboard motors 501 and 503 that each generate a propulsive force are changed, respectively, to be about −10 and about +10 degrees so as to follow the leftward pivoting direction of the hull 100. That is, in both of the cases above, the steering angles of the right and left outboard motors 501 and 503 are changed such that the rear end portions of the right and left outboard motors 501 and 503 are brought close to each other.

It is noted that the right and left outboard motors 501 and 503 are, respectively, examples of "first propulsion device group" and "second propulsion device group" according to a preferred embodiment of the present invention. The center outboard motor 502 is an example of a "first propulsion device group" according to a preferred embodiment of the present invention if the steering angle thereof is changed together with the right outboard motor 501, while an example of a "second propulsion device group" according to a preferred embodiment of the present invention if the steering angle thereof is changed together with the left outboard motor 503.

Advantages of the fifth preferred embodiment are substantially the same as those of the above-described first preferred embodiment.

Sixth Preferred Embodiment

A sixth preferred embodiment of the present invention will be described with reference to FIGS. 22 and 22A. In the sixth preferred embodiment, three outboard motors are controlled based on the operations of three operation levers, unlike the above-described fifth preferred embodiment. In FIG. 22A, components identical to those in FIG. 21A are designated by the same reference numerals.

Figure 22:
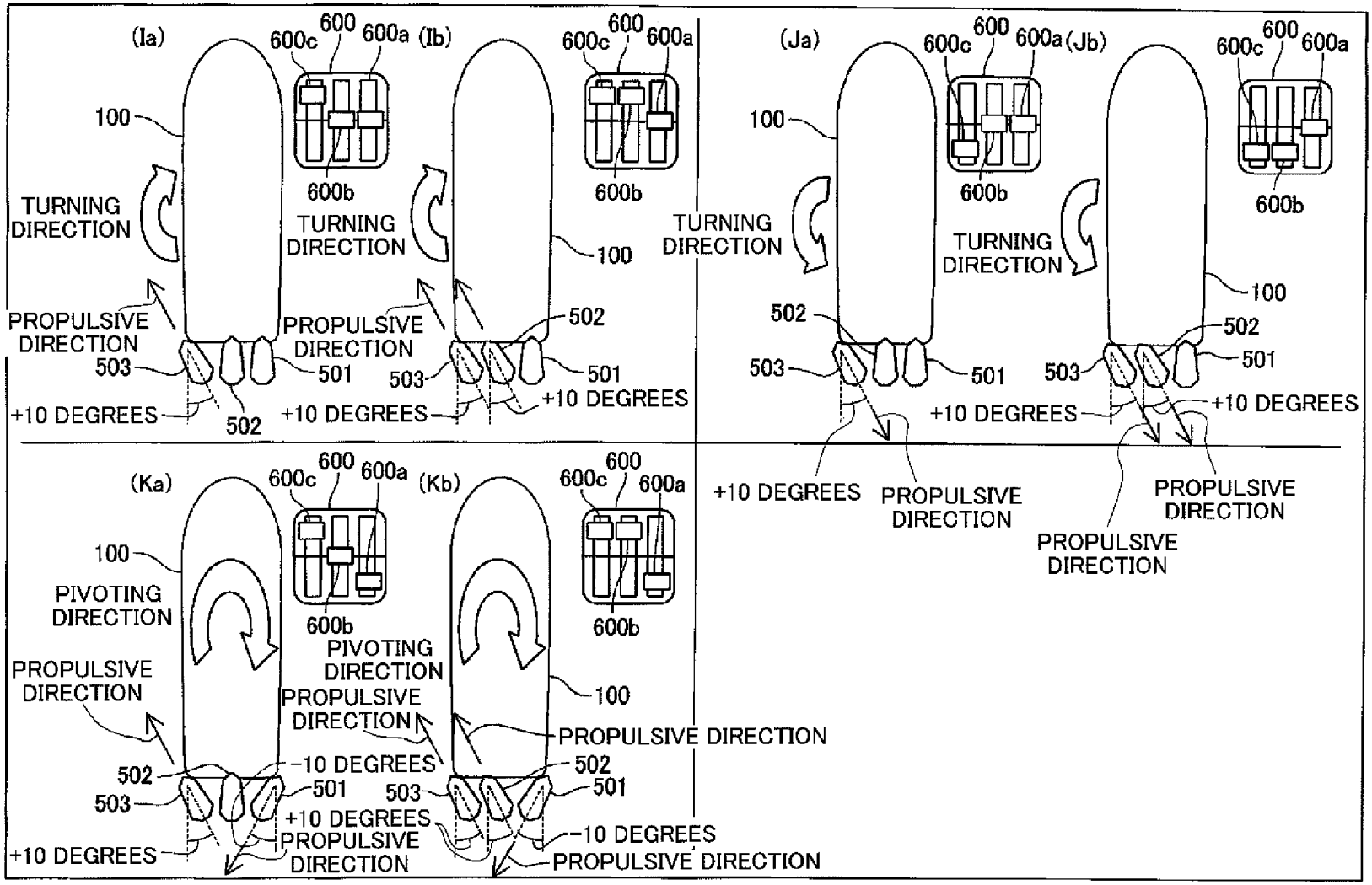
FIG. 22 illustrates steering angle control when a marine vessel propulsion system according to a sixth preferred embodiment of the present invention is in an assisted marine vessel maneuvering mode.
Figure 22A:
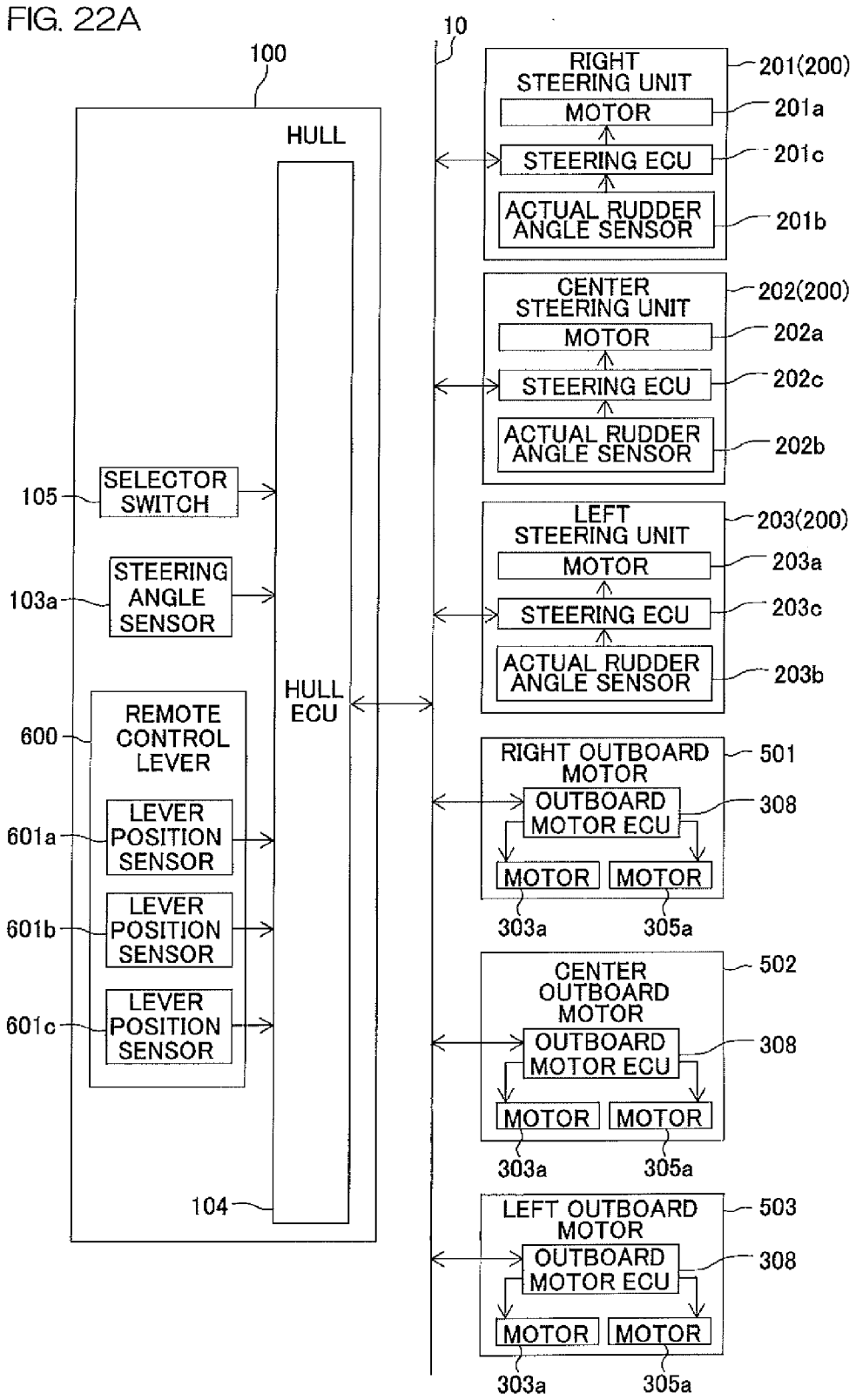
FIG. 22A is a block diagram showing the electrical configuration of the marine vessel propulsion system.

In the sixth preferred embodiment, three operation levers 600 (right operation lever 600*a*, center operation lever 600*b*, and left operation lever 600*c*) are provided correspondingly to the three outboard motors (right outboard motor 501, center outboard motor 502, and left outboard motor 503) as shown in FIG. 22. Three lever position sensors 601*a*, 601*b*, and 601*c* are also provided correspondingly to the three operation levers, and output signals from these sensors are fed into the hull ECU 104.

The shift states and throttle opening degrees of the respective right, center, and left outboard motors 501, 502, and 503 are controlled correspondingly to the positions of the respective right, center, and left operation levers 600*a*, 600*b*, and 600*c*. The hull ECU 104 is arranged, in the assisted marine vessel maneuvering mode, to control the shift states, throttle opening degrees, and steering angles of the three outboard motors based on detection results from the three lever position sensors 601*a*, 601*b*, and 601*c*. Also, in the sixth preferred embodiment, the steering angles of the outboard motors are changed to facilitate the behavior of the hull 100 using substantially the same patterns as in the above-described first and fifth preferred embodiments.

For example, as shown in (Ia) of FIG. 22, when the right, center, and left operation levers 600*a*, 600*b*, and 600*c* are, respectively, in the neutral, neutral, and forward drive positions, only the left outboard motor 503 generates a propulsive force. Therefore, the steering angle of the left outboard motor 503 is only changed to be about +10 degrees, for example, so as to follow the right-forward turning direction of the hull 100. The steering angles of the right and center outboard motors 501 and 502 are kept at 0 degrees. Also, as shown in (Ib) of FIG. 22, when the right, center, and left operation levers 600*a*, 600*b*, and 600*c* are, respectively, in the neutral, forward drive, and forward drive positions, the center outboard motor 502 also generates a propulsive force. Therefore, the steering angles of the left and center outboard motors 503 and 502 are changed to be about +10 degrees, for example, so as to follow the right-forward turning direction of the hull 100. The steering angle of the right outboard motor 501 is kept at 0 degrees.

As shown in (Ja) of FIG. 22, when the right, center, and left operation levers 600*a*, 600*b*, and 600*c* are, respectively, in the neutral, neutral, and reverse drive positions, only the left outboard motor 503 generates a propulsive force. Therefore, the steering angle of the left outboard motor 503 is only changed to be about +10 degrees, for example, so as to follow the right-backward turning direction of the hull 100. The steering angles of the right and center outboard motors 501 and 502 are kept at 0 degrees. Also, as shown in (Jb) of FIG. 22, when the right, center, and left operation levers 600*a*, 600*b*, and 600*c* are, respectively, in the neutral, reverse drive, and reverse drive positions, not only the left outboard motor 503 but also the center outboard motor 502 generates a propulsive force. Therefore, the steering angles of the center and left outboard motors 502 and 503 are changed to be about +10 degrees, for example, so as to follow the right-backward turning direction of the hull 100. The steering angle of the right outboard motor 501 is kept at 0 degrees.

Similarly, when the right, center, and left operation levers 600*a*, 600*b*, and 600*c* are, respectively, in the forward drive, neutral, and neutral positions, only the right outboard motor 501 generates a propulsive force. Therefore, the steering angle of the right outboard motor 501 is only changed to be about −10 degrees, for example, so as to follow the left-forward turning direction of the hull 100. The steering angles of the left and center outboard motors 503 and 502 are kept at 0 degrees. Also, when the right, center, and left operation levers 600*a*, 600*b*, and 600*c* are, respectively, in the forward drive, forward drive, and neutral positions, the center outboard motor 502 also generates a propulsive force. Therefore, the steering angles of the right and center outboard motors 501 and 502 are changed to be about −10 degrees, for example, so as to follow the left-forward turning direction of the hull 100. The steering angle of the left outboard motor 503 is kept at 0 degrees.

When the right, center, and left operation levers 600*a*, 600*b*, and 600*c* are, respectively, in the reverse drive, neutral, and neutral positions, only the right outboard motor 501 generates a propulsive force. Therefore, the steering angle of the right outboard motor 501 is only changed to be about −10 degrees, for example, so as to follow the left-backward turning direction of the hull 100. The steering angles of the left and center outboard motors 503 and 502 are kept at 0 degrees. Also, when the right, center, and left operation levers 600*a*, 600*b*, and 600*c* are, respectively, in the reverse drive, reverse drive, and neutral positions, not only the right outboard motor 501 but also the center outboard motor 502 generates a propulsive force. Therefore, the steering angles of the right and center outboard motors 501 and 502 are changed to be about −10 degrees, for example, so as to follow the left-backward turning direction of the hull 100. The steering angle of the left outboard motor 503 is kept at 0 degrees.

(Ka) of FIG. 22 represents the case where the right, center, and left operation levers 600*a*, 600*b*, and 600*c* are, respectively, in the reverse drive, neutral, and forward drive positions. In this case, the steering angles of the right and left outboard motors 501 and 503 are changed, respectively, to be about −10 and about +10 degrees, for example, so as to follow the rightward pivoting direction of the hull 100. That is, the steering angles of the right and left outboard motors 501 and 503 are changed such that the rear end portions of the right and left outboard motors 501 and 503 are brought close to each other. The steering angle of the center outboard motor 502 remains unchanged at 0 degrees.

The same applies to the case where the right, center, and left operation levers 600*a*, 600*b*, and 600*c* are, respectively, in the forward drive, neutral, and reverse drive positions. In this case, the steering angles of the right and left outboard motors 501 and 503 are changed, respectively, to be about −10 and about +10 degrees, for example, so as to follow the leftward pivoting direction of the hull 100. That is, the steering angles of the right and left outboard motors 501 and 503 are changed such that the rear end portions of the right and left outboard motors 501 and 503 are brought close to each other. The steering angle of the center outboard motor 502 remains unchanged at 0 degrees.

Also, (Kb) of FIG. 22 represents the case where the right, center, and left operation levers 600*a*, 600*b*, and 600*c* are, respectively, in the reverse drive, forward drive, and forward drive positions. In this case, the steering angles of the right, center, and left outboard motors 501, 502, and 503 are changed, respectively, to be about −10, about +10, and about +10 degrees, for example, so as to follow the rightward pivoting direction of the hull 100. That is, the steering angles of the right, center, and left outboard motors 501, 502, and 503 are changed such that the rear end portion of the right outboard motor 501 and the rear end portions of the left as well as center outboard motors 503 and 502 are brought close to each other.

The same applies to the case where the right, center, and left operation levers 600*a*, 600*b*, and 600*c* are, respectively, in the forward drive, forward drive, and reverse drive positions. In this case, the steering angles of the right, center, and left outboard motors 501, 502, and 503 are changed, respectively, to be about −10, about −10, and about +10 degrees, for example, so as to follow the leftward pivoting direction of the hull 100. That is, the steering angles of the right, center, and left outboard motors 501, 502, and 503 are changed such that the rear end portions of the right as well as center outboard motors 501 and 502 and the rear end portion of the left outboard motor 503 are brought close to each other.

When the right, center, and left operation levers 600*a*, 600*b*, and 600*c* are, respectively, in the reverse drive, reverse drive, and forward drive positions, the following operation will occur. That is, the steering angles of the right, center, and left outboard motors 501, 502, and 503 are changed, respectively, to be about −10, about −10, and about +10 degrees, for example, so as to follow the rightward pivoting direction of the hull 100. In this case, the steering angles of the right, center, and left outboard motors 501, 502, and 503 are changed such that the rear end portions of the right as well as center outboard motors 501 and 502 and the rear end portion of the left outboard motor 503 are brought close to each other.

The same applies to the case where the right, center, and left operation levers 600*a*, 600*b*, and 600*c* are, respectively, in the forward drive, reverse drive, and reverse drive positions. That is, the steering angles of the right, center, and left outboard motors 501, 502, and 503 are changed, respectively, to be about −10, about +10, and about +10 degrees, for example, so as to follow the leftward pivoting direction of the hull 100. In this case, the steering angles of the right, center, and left outboard motors 501, 502, and 503 are changed such that the rear end portion of the right outboard motor 501 and the rear end portions of the left as well as center outboard motors 503 and 502 are brought close to each other.

The right and left operation levers 600*a* and 600*c* are, respectively, examples of "first operation lever" and "second operation lever" according to a preferred embodiment of the present invention. The center operation lever 600*b* is an example of a "first operation lever" according to a preferred embodiment of the present invention if in the same position as the right operation lever 600*a*, while an example of a "second operation lever" according to a preferred embodiment of the present invention if in the same position as the left operation lever 600*c*.

Advantages of the sixth preferred embodiment are substantially the same as those of the above-described first preferred embodiment.

Other Preferred Embodiments

The above-disclosed preferred embodiments of the present invention are to be considered in all aspects only as illustrative and not restrictive. The scope of the present invention is not defined by the above-described preferred embodiments, but rather by the claims appended hereto. Further, the present invention includes all the modifications within the meaning and scope equivalent to those defined by the appended claims.

For example, although the first to sixth preferred embodiments above describe the case where two or three operation levers are preferably used to steer two or three outboard motors, the present invention is not restricted thereto. Two or more operation levers may be used to steer four or more outboard motors, including the case, for example, where two operation levers are used to steer four outboard motors.

Although the first to sixth preferred embodiments above describe the case where outboard motors that generate a propulsive force by rotating a propeller with a driving force from an engine are preferably adopted, the present invention is not restricted thereto. That is, outboard motors and other propulsion devices may be adopted that generate a propulsive force by rotating a propeller with a driving force from an electric motor. Not only propulsion devices that generate a propulsive force by rotating a propeller but also propulsion devices (jet propulsion devices) that generate a propulsive force through jet drive in which water is jetted through an injection nozzle may be adopted.

Although the first to sixth preferred embodiments above describe the case where a marine vessel maneuvering operator preferably operates the selector switch to switch between the normal marine vessel maneuvering mode and the assisted marine vessel maneuvering mode, the present invention is not restricted thereto. That is, it may be arranged that the normal marine vessel maneuvering mode switches automatically to the assisted marine vessel maneuvering mode if predetermined conditions are met.

Although the first to sixth preferred embodiments above describe the case where the normal marine vessel maneuvering mode is preferably switchable to one assisted marine vessel maneuvering mode, the present invention is not restricted thereto. For example, it may be arranged that the operator can select from among multiple assisted marine vessel maneuvering modes. The multiple assisted marine vessel maneuvering modes may include any two or more modes described in the first to sixth preferred embodiments.

Although the first preferred embodiment above describes the case where the amount of change in the steering angle of each outboard motor is preferably fixed to about 10 degrees, for example, the present invention is not restricted thereto. The steering angle may be changed to a value other than approximately 10 degrees.

Although the first preferred embodiment above describes the case where the amount of change in the steering angle of the right outboard motor and the amount of change in the steering angle of the left outboard motor are preferably both set to the same angle (e.g., about 10 degrees), the present invention is not restricted thereto. That is, the amount of change in the steering angle of the right outboard motor may be different from the amount of change in the steering angle of the left outboard motor.

Although the first preferred embodiment above describes the case where the steering angle of each outboard motor is preferably changed when the shift state corresponding to the position of the right operation lever 102*a* is different from the shift state corresponding to the position of the left operation lever 102*b*, the present invention is not restricted thereto. For example, even if the shift state corresponding to the position of the right operation lever 102*a* may be the same as the shift state corresponding to the position of the left operation lever 102*b* (e.g., both in the forward drive position), the steering angle of each outboard motor may be changed from its neutral position when the right and left operation levers 102*a* and 102*b* are in their respective different positions (i.e., the throttle opening degree commands for the right and left outboard motors are different from each other).

Although the second preferred embodiment above describes the case where the amount of displacement of each operation lever is preferably proportional to the amount of change in the steering angle of each outboard motor, the present invention is not restricted thereto. The relationship therebetween may not be a proportional one.

Figure 23:
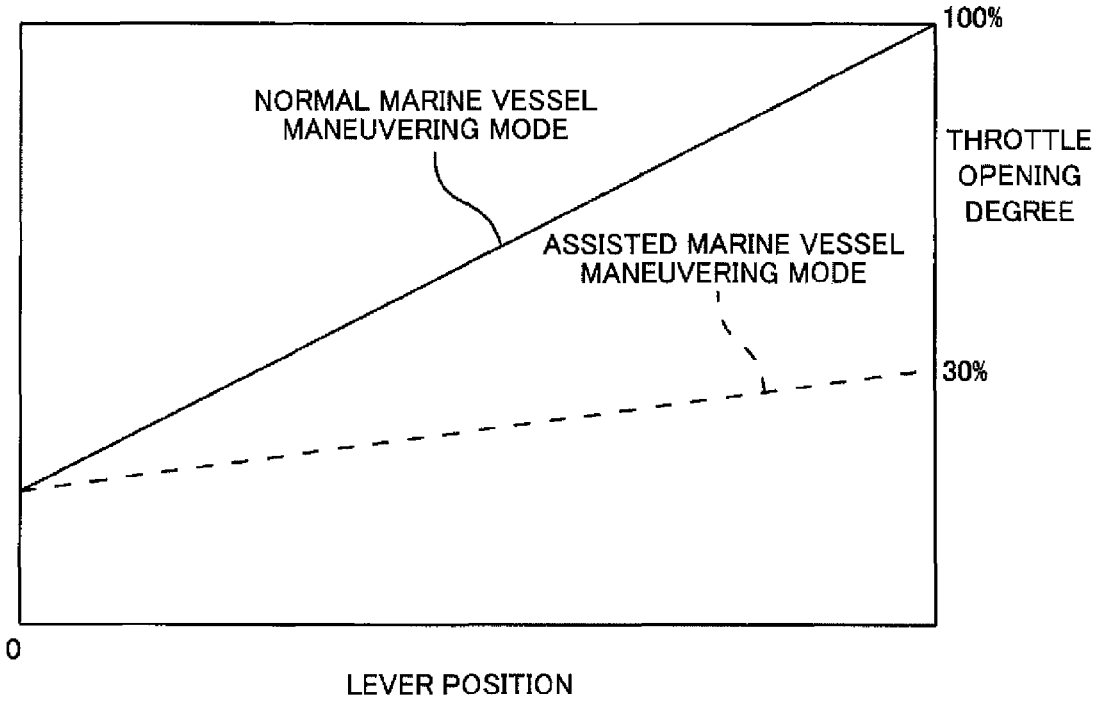
FIG. 23 shows throttle opening degree control when a marine vessel propulsion system according to an exemplary variation of the first preferred embodiment of the present invention is in normal and assisted marine vessel maneuvering modes.

Although the first preferred embodiment above describes the case where the throttle opening degree is preferably controlled such that the relationship between the amount of displacement of each operation lever and the throttle opening degree in the assisted marine vessel maneuvering mode is the same as in the normal marine vessel maneuvering mode, the present invention is not restricted thereto. That is, in the assisted marine vessel maneuvering mode, the throttle opening degree may be controlled to be smaller than in the normal marine vessel maneuvering mode. For example, as shown in FIG. 23, the throttle opening degree may be controlled according to the characteristics in that the throttle opening degree at the maximum amount of displacement of each operation lever is approximately 30% of the maximum throttle opening degree in the normal marine vessel maneuvering mode, for example. Alternatively, an upper limit may preliminarily be set on the engine speed, and in the assisted marine vessel maneuvering mode, the throttle opening degree may be controlled such that the engine speed does not exceed the upper limit.

While preferred embodiments of the present invention have been described above, it is to be understood that variations and modifications will be apparent to those skilled in the art without departing the scope and spirit of the present invention. The scope of the present invention, therefore, is to be determined solely by the following claims.

The present application corresponds to Japanese Patent Application No. 2009-014987 filed in the Japan Patent Office on Jan. 27, 2009, and the entire disclosure of the application is incorporated herein by reference.

What is claimed is:

1. A marine vessel propulsion system comprising:

a plurality of outboard motors arranged to be mounted on a hull so as to enable a steering angle of each of the plurality of outboard motors to change with respect to the hull, each of the steering angles of the plurality of outboard motors having a maximum angular range of about 60 degrees;

a plurality of operation levers provided correspondingly to the plurality of outboard motors, the plurality of operation levers arranged to be operated by a marine vessel maneuvering operator to control the plurality of outboard motors to change respective shift states selected from among a forward drive state, a neutral state, and a reverse drive state;

a plurality of lever position sensors provided correspondingly to the plurality of operation levers and arranged to detect positions of the plurality of operation levers and to output a plurality of detection results; and a control unit programmed to control the shift states of the respective outboard motors and to change the steering angle of at least one of the outboard motors based only on the plurality of detection results from the plurality of lever position sensors in order to turn, pivot, or laterally move the hull due to a direction of a propulsive force of the at least one of the outboard motors.

2. The marine vessel propulsion system according to claim 1, wherein the control unit is programmed to control the shift states of the plurality of respective outboard motors based on detection results from the plurality of lever position sensors such that the positions of the plurality of operation levers correspond to the shift states of the respective outboard motors.

3. The marine vessel propulsion system according to claim 2, wherein the plurality of outboard motors include a first outboard motor group including at least one of the outboard motors and a second outboard motor group including at least one of the outboard motors not included in the first outboard motor group;

the plurality of operation levers include a first operation lever corresponding to the first outboard motor group and a second operation lever corresponding to the second outboard motor group;

the control unit is programmed to change, when a position of the first operation lever is different from a position of the second operation lever, the steering angle of at least one of the outboard motors to facilitate the behavior of the hull corresponding to shift states of the respective first and second outboard motor groups.

4. The marine vessel propulsion system according to claim 3, wherein the first and second operation levers are arranged to be movable among a forward drive position corresponding to the forward drive state, a neutral position corresponding to the neutral state, and a reverse drive position corresponding to the reverse drive state;

the control unit is programmed to change, when the position of the first operation lever is different from the position of the second operation lever, the steering angle of at least one of the outboard motors to facilitate the behavior of the hull corresponding to the shift states of the respective first and second outboard motor groups.

5. The marine vessel propulsion system according to claim 4, wherein the control unit is programmed to control, when the first operation lever is in the neutral position and the second operation lever is in a position other than the neutral position, the shift state of the first outboard motor group to be the neutral state and the shift state of the second outboard motor group to be the forward or reverse drive state and to change the steering angle of at least one of the outboard motors so as to face a direction to facilitate a turning motion of the hull corresponding to a combination of the shift states of the respective first and second outboard motor groups.

6. The marine vessel propulsion system according to claim 4, wherein the control unit is programmed to change, when the first operation lever is in one of the forward and reverse drive positions and the second operation lever is in the other of the forward and reverse drive positions, the steering angles of the respective first and second outboard motor groups to bring a rear end portion of the first outboard motor group and a rear end portion of the second outboard motor group close to each other so that the hull pivots.

7. The marine vessel propulsion system according to claim 5, wherein the control unit is programmed to change an amount of change in the steering angle of each outboard motor according to an amount of displacement of each operation lever with respect to the neutral position.

8. The marine vessel propulsion system according to claim 5, wherein the control unit is programmed to maintain a certain amount of change in the steering angle of each outboard motor regardless of an amount of displacement of each operation lever with respect to the neutral position.

9. The marine vessel propulsion system according to claim 1, further comprising:

a steering mechanism arranged to be operated by the marine vessel maneuvering operator to change the steering angles of the plurality of respective outboard motors;

a steering angle sensor arranged to detect a rotation angle of the steering mechanism; and a switching unit arranged to switch between normal marine vessel maneuvering control and assisted marine vessel maneuvering control; wherein in the normal marine vessel maneuvering control, the control unit is programmed to control the shift states and propulsive forces of the respective outboard motors based on detection results from the plurality of lever position sensors and to change the steering angles of the respective outboard motors based on a detection result from the steering angle sensor; and in the assisted marine vessel maneuvering control, the control unit is programmed to control, based on detection results from the plurality of lever position sensors, the shift states and propulsive forces of the respective outboard motors and to change the steering angle of at least one of the outboard motors to facilitate the behavior of the hull corresponding to the shift states of the respective outboard motors.

10. The marine vessel propulsion system according to claim 9, wherein in the assisted marine vessel maneuvering control, the control unit is programmed to control each of the outboard motors to have a propulsive force smaller than that corresponding to the position of each operation lever in the normal marine vessel maneuvering control.

11. The marine vessel propulsion system according to claim 1, wherein each of the plurality of outboard motors includes an engine with a driving force thereof being adjustable through control of throttle opening degree, a propeller arranged to be rotated by a driving force from the engine, and a switching mechanism portion arranged to switch shift states;

the plurality of operation levers are arranged to be operated by the marine vessel maneuvering operator to control the plurality of outboard motors of their respective shift states and throttle opening degrees; and the control unit is programmed to control, based on detection results from the plurality of lever position sensors, the shift states and throttle opening degrees of the respective outboard motors and to change the steering angle of at least one of the outboard motors to facilitate the behavior of the hull corresponding to the shift states of the respective outboard motors.

12. A marine vessel propulsion system comprising:

a plurality of outboard motors arranged to be mounted on a hull so as to enable a steering angle of each of the plurality of outboard motors to change with respect to the hull, each of the steering angles of the plurality of outboard motors having a maximum angular range of about 60 degrees, the outboard motors including a first outboard motor group including at least one of the outboard motors and a second outboard motor group including at least one of the outboard motors not included in the first outboard motor group;

a plurality of operation levers provided correspondingly to the plurality of outboard motors, the plurality of operation levers arranged to be movable among a forward drive position corresponding to a forward drive state, a neutral position corresponding to a neutral state, and a reverse drive position corresponding to a reverse drive state to control the plurality of outboard motors to change respective shift states selected from among the forward drive state, neutral state, and reverse drive state, the plurality of operation levers including a first operation lever corresponding to the first outboard motor group and a second operation lever corresponding to the second outboard motor group;

a plurality of lever position sensors provided correspondingly to the plurality of operation levers and arranged to detect positions of the plurality of operation levers and to output a plurality of detection results; and a control unit programmed to control the shift states of the respective outboard motors based on the plurality of detection results from the plurality of lever position sensors and, when the first operation lever is in one of the forward and reverse drive positions and the second operation lever is in the other of the forward and reverse drive positions, the control unit is programmed to change the steering angles of the respective first and second outboard motor groups to move a rear end portion of the first outboard motor group and a rear end portion of the second outboard motor group away from each other so that a resultant vector of propulsive force vectors generated by the first and second outboard motor groups moves the hull laterally.

13. The marine vessel propulsion system according to claim 12, further comprising:

a steering mechanism arranged to be operated by a marine vessel maneuvering operator to change the steering angles of the plurality of respective outboard motors;

a steering angle sensor arranged to detect a rotation angle of the steering mechanism; and a switching unit arranged to switch between normal marine vessel maneuvering control and assisted marine vessel maneuvering control; wherein in the normal marine vessel maneuvering control, the control unit is programmed to control the shift states and propulsive forces of the respective outboard motors based on detection results from the plurality of lever position sensors and to change the steering angles of the respective outboard motors based on a detection result from the steering angle sensor; and in the assisted marine vessel maneuvering control, the control unit is programmed to control the shift states and propulsive forces of the respective outboard motors based on detection results from the plurality of lever position sensors and, when the first operation lever is in one of the forward and reverse drive positions and the second operation lever is in the other of the forward and reverse drive positions, to change the steering angles of the respective first and second outboard motor groups to move the rear end portion of the first outboard motor group and the rear end portion of the second outboard motor group away from each other so that the hull moves laterally.

14. The marine vessel propulsion system according to claim 13, wherein in the assisted marine vessel maneuvering control, the control unit is programmed to control each of the outboard motors to have a propulsive force smaller than that corresponding to the position of each operation lever in the normal marine vessel maneuvering control.

15. The marine vessel propulsion system according to claim 12, wherein each of the plurality of outboard motors includes an engine with a driving force thereof being adjustable through control of throttle opening degree, a propeller arranged to be rotated by a driving force from the engine, and a switching mechanism portion arranged to switch shift states;

the plurality of operation levers are arranged to be operated by a marine vessel maneuvering operator to control the plurality of outboard motors of their respective shift states and throttle opening degrees; and the control unit is programmed to control the shift states and throttle opening degrees of the respective outboard motors based on detection results from the plurality of lever position sensors and, when the first operation lever is in one of the forward and reverse drive positions and the second operation lever is in the other of the forward and reverse drive positions, to change the steering angles of the respective first and second outboard motor groups to move an outboard motor rear end portion of the first outboard motor group and an outboard motor rear end portion of the second outboard motor group away from each other so that the hull moves laterally.

16. A marine vessel comprising:

a hull;

a plurality of outboard motors mounted on the hull so as to enable a steering angle of each of the plurality of outboard motors to change with respect to the hull, each of the steering angles of the plurality of outboard motors having a maximum angular range of about 60 degrees, the outboard motors including a first outboard motor group including at least one of the outboard motors and a second outboard motor group including at least one of the outboard motors not included in the first outboard motor group;

a plurality of operation levers provided correspondingly to the plurality of outboard motors, the plurality of operation levers arranged to be movable among a forward drive position corresponding to a forward drive state, a neutral position corresponding to a neutral state, and a reverse drive position corresponding to a reverse drive state to control the plurality of outboard motors to change respective shift states selected from among the forward drive state, neutral state, and reverse drive state, the plurality of operation levers including a first operation lever corresponding to the first outboard motor group and a second operation lever corresponding to the second outboard motor group;

a plurality of lever position sensors provided correspondingly to the plurality of operation levers and arranged to detect positions of the plurality of operation levers and to output a plurality of detection results; and a control unit programmed to control the shift states of the respective outboard motors based on the plurality of detection results from the plurality of lever position sensors and, when the first operation lever is in one of the forward and reverse drive positions and the second operation lever is in the other of the forward and reverse drive positions, the control unit is programmed to change the steering angles of the respective first and second outboard motor groups to move a rear end portion of the first outboard motor group and a rear end portion of the second outboard motor group away from each other so that a resultant vector of propulsive force vectors generated by the first and second outboard motor groups moves the hull laterally.

17. A marine vessel propulsion system comprising:

a plurality of outboard motors arranged to be mounted on a hull so as to enable a steering angle of each of the plurality of outboard motors to change with respect to the hull, each of the steering angles of the plurality of outboard motors having a maximum angular range of about 60 degrees;

a plurality of operation levers provided correspondingly to the plurality of outboard motors, the plurality of operation levers arranged to be operated by a marine vessel maneuvering operator to control the plurality of outboard motors to change respective shift states selected from among a forward drive state, a neutral state, and a reverse drive state;

a plurality of lever position sensors provided correspondingly to the plurality of operation levers and arranged to detect positions of the plurality of operation levers; and a control unit programmed to control, based on detection results from the plurality of lever position sensors, the shift states of the respective outboard motors and to change the steering angle of at least one of the outboard motors; wherein the control unit is programmed to determine the shift states of the respective outboard motors and the steering angle of the at least one of the outboard motors based only on the positions of the plurality of operation levers detected by the plurality of lever position sensors and a predetermined relationship of the shift states and the steering angle with respect to the positions of the plurality of operation levers in order to turn, pivot, or laterally move the hull due to a direction of a propulsive force of the at least one of the outboard motors.

18. A marine vessel comprising:

a hull;

a plurality of outboard motors mounted on the hull so as to enable a steering angle of each of the plurality of outboard motors to change with respect to the hull, each of the steering angles of the plurality of outboard motors having a maximum angular range of about 60 degrees;

a plurality of operation levers provided correspondingly to the plurality of outboard motors, the plurality of operation levers arranged to be operated by a marine vessel maneuvering operator to control the plurality of outboard motors to change respective shift states selected from among a forward drive state, a neutral state, and a reverse drive state;

a plurality of lever position sensors provided correspondingly to the plurality of operation levers and arranged to detect positions of the plurality of operation levers; and a control unit programmed to control, based on detection results from the plurality of lever position sensors, the shift states of the respective outboard motors and to change the steering angle of at least one of the outboard motors; and the control unit is programmed to determine the shift states of the respective outboard motors and the steering angle of the at least one of the outboard motors based only on the positions of the plurality of operation levers detected by the plurality of lever position sensors and a predetermined relationship of the shift states and the steering angle with respect to the positions of the plurality of operation levers in order to turn, pivot, or laterally move the hull due to a direction of a propulsive force of the at least one of the outboard motors.

19. The marine vessel propulsion system according to claim 1, wherein the control unit is programmed to determine a relative positional relationship among the plurality of operation levers based on the outputs of the plurality of the lever position sensors, and to control the shift states of the respective outboard motors and the steering angle of at least one of the outboard motors based on the relative positional relationship.

20. The marine vessel propulsion system according to claim 1, wherein the control unit is programmed to change the steering angle of at least two of the outboard motors based only on the plurality of detection results from the plurality of lever position sensors in order to laterally move the hull due to a direction of propulsive forces of the at least two of the outboard motors.

21. The marine vessel propulsion system according to claim 17, wherein the control unit is programmed to change the steering angle of at least two of the outboard motors based only on the plurality of detection results from the plurality of lever position sensors in order to laterally move the hull due to a direction of propulsive forces of the at least two of the outboard motors.

22. A marine vessel comprising:

a hull;

a plurality of outboard motors mounted on the hull so as to enable a steering angle of each of the plurality of outboard motors to change with respect to the hull, each of the steering angles of the plurality of outboard motors having a maximum angular range of about 60 degrees;

a plurality of operation levers provided correspondingly to the plurality of outboard motors, the plurality of operation levers arranged to be operated by a marine vessel maneuvering operator to control the plurality of outboard motors to change respective shift states selected from among a forward drive state, a neutral state, and a reverse drive state;

a plurality of lever position sensors provided correspondingly to the plurality of operation levers and arranged to detect positions of the plurality of operation levers and to output a plurality of detection results; and a control unit programmed to control the shift states of the respective outboard motors and to change the steering angle of at least one of the outboard motors based only on the plurality of detection results from the plurality of lever position sensors in order to turn, pivot, or laterally move the hull due to a direction of a propulsive force of the at least one of the outboard motors.

23. The marine vessel propulsion system according to claim 12, wherein the control unit is programmed to maintain a certain amount of change in the steering angle of each outboard motor regardless of an amount of displacement of each operation lever with respect to the neutral position.

24. The marine vessel propulsion system according to claim 12, wherein the control unit is programmed to change an amount of change in the steering angle of each outboard motor according to an amount of displacement of each operation lever with respect to the neutral position.

25. The marine vessel propulsion system according to claim 22, wherein the control unit is programmed to change the steering angle of at least two of the outboard motors based only on the plurality of detection results from the plurality of lever position sensors in order to laterally move the hull due to a direction of propulsive forces of the at least two of the outboard motors.

26. The marine vessel propulsion system according to claim 18, wherein the control unit is programmed to change the steering angle of at least two of the outboard motors based only on the plurality of detection results from the plurality of lever position sensors in order to laterally move the hull due to a direction of propulsive forces of the at least two of the outboard motors.

* * * * *